US010578998B1

(12) United States Patent
Koyanagi et al.

(10) Patent No.: US 10,578,998 B1
(45) Date of Patent: Mar. 3, 2020

(54) FIXING DEVICE AND IMAGE FORMING APPARATUS

(71) Applicant: FUJI XEROX CO., LTD., Tokyo (JP)

(72) Inventors: Kiyoshi Koyanagi, Kanagawa (JP); Takaaki Sato, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/294,939

(22) Filed: Mar. 7, 2019

(30) Foreign Application Priority Data

Sep. 12, 2018 (JP) ..... 2018-170259

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2053; G03G 15/2028; G03G 15/2039
See application file for complete search history.

(56) References Cited

U.S. PATENT DOCUMENTS 8,712,268 B2 4/2014 Iwasaki
2012/0121284 A1* 5/2012 Iwasaki ..... G03G 15/2053 399/67

(Continued)

FOREIGN PATENT DOCUMENTS

JP H05-289555 11/1993
JP 2008-275859 11/2008
JP 2012-103526 5/2012

*Primary Examiner* — G. M. A Hyder
(74) *Attorney, Agent, or Firm* — JCIPRNET

(57) ABSTRACT

A fixing device includes an endless belt that rotates in a circumferential direction and that comes into contact with a recording medium, which is transported, at an outer peripheral surface of the endless belt, a heat generating plate that includes at least one heat generating portion and extends in an axial direction of the endless belt in such a manner that a surface of the heat generating plate is in contact with an inner peripheral surface of the endless belt, the heat generating portion being formed in such a manner as to extend in the axial direction and in such a manner as to generate heat, a heat conducting unit that is in contact with a rear surface of a portion of the heat generating plate, the portion being different from a portion of the heat generating plate on which the heat generating portion is formed in a transport direction of the recording medium, and that conducts heat generated by the heat generating portion in the axial direction, an urging unit that urges the heat conducting unit toward the heat generating plate, a pressing unit that is disposed in such a manner as to oppose the heat generating plate with the endless belt interposed between the pressing unit and the heat generating plate and that forms a nip between the pressing unit and the endless belt in such a manner as to press the recording medium, which is transported, against the endless belt, and a moving unit that causes the pressing unit to move relative to the endless belt in such a manner as to set a nip width of the nip in a heating mode in which the endless belt is heated to be smaller than the nip width of the nip in a fixing mode in which an image is fixed onto the recording medium. When the heat generating portion that is included in a region of the nip in the transport direction of the recording medium and that generates heat in the heating mode has a length L1, the heat conducting unit that is included in the region of the nip in the transport direction in the heating mode has a length S1, the heat generating portion that is included in the region of the nip in the transport direction and that generates heat in the fixing mode has a length L2, and the heat conducting unit that is included in the region of the nip in the transport direction in the fixing mode has a length S2, the following formula (1) is satisfied.

$$L2-L1<S2-S1 \quad (1)$$

14 Claims, 15 Drawing Sheets

(56) References Cited

U.S. PATENT DOCUMENTS

2014/0186077 A1* 7/2014 Lee ..... G03G 15/2017
399/329
2017/0363996 A1* 12/2017 Kikuchi ..... G03G 15/2028

* cited by examiner

FIXING DEVICE AND IMAGE FORMING APPARATUS

CROSS-REFERENCE TO RELATED APPLICATIONS

This application is based on and claims priority under 35 USC 119 from Japanese Patent Application No. 2018-170259 filed Sep. 12, 2018.

BACKGROUND

(i) Technical Field

The present disclosure relates to a fixing device and an image forming apparatus.

(ii) Related Art

Japanese Unexamined Patent Application Publication No. 5-289555 describes a fixing device in which a recording material carrying an unfixed visual image and a fixing film are caused to pass through a nip part formed between a heating member and a pressing member in such a manner that the visual image is heated and fixed onto the recording material and in which a highly thermal-conductive member is provided on the rear surface of the heating member.

There is a fixing device including an endless belt that rotates and comes into contact with a recording medium, which is transported, at the outer peripheral surface thereof and a heat generating plate that includes a heat generating portion formed such that a surface of the heat generating portion is in contact with the inner peripheral surface of the endless belt and such that the heat generating portion generates heat for heating a portion of the inner peripheral surface of the endless belt. The fixing device further includes a heat conducting unit that is in contact with the rear surface of a portion of the heat generating plate, the portion being different from a portion of the heat generating plate in which the heat generating portion is formed in a transport direction of the recording medium, and that conducts heat generated by the heat generating portion in an axial direction and an urging unit that urges the heat conducting unit toward the heat generating plate. The fixing device further includes a pressing unit that forms a nip between the pressing unit and the endless belt and that presses the recording medium against the outer peripheral surface of the endless belt.

In such a fixing device, there is a case where, in a heating mode (a start-up mode) in which an endless belt is heated, a pressing unit is caused to move so as to set a nip width of a nip to be smaller than that in a fixing mode in which an image is fixed onto a recording medium. More specifically, the nip width is set to be small in the heating mode in order not to allow heat generated by a heat generating portion to be transferred to the pressing unit.

Here, if the entire heat conducting unit is included in the region of the nip in the heating mode, the heat-transfer coefficient between a heat generating plate and the heat conducting unit will be high, and heat generated by the heat generating portion will be transferred to the heat conducting unit, so that, in the heating mode, it will take a long time to heat the endless belt. In other words, in the heating mode, it will take a long time to heat the heat generating plate.

SUMMARY

Aspects of non-limiting embodiments of the present disclosure relate to reducing the time taken for a heat generating plate to reach a specified temperature in a heating mode compared with the case where the length of a heat conducting unit that is included in the region of a nip in the heating mode and the length of the heat conducting unit that is included in the region of the nip in a fixing mode are equal to each other.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including an endless belt that rotates in a circumferential direction and that comes into contact with a recording medium, which is transported, at an outer peripheral surface of the endless belt, a heat generating plate that includes at least one heat generating portion and extends in an axial direction of the endless belt in such a manner that a surface of the heat generating plate is in contact with an inner peripheral surface of the endless belt, the heat generating portion being formed in such a manner as to extend in the axial direction and in such a manner as to generate heat, a heat conducting unit that is in contact with a rear surface of a portion of the heat generating plate, the portion being different from a portion of the heat generating plate on which the heat generating portion is formed in a transport direction of the recording medium, and that conducts heat generated by the heat generating portion in the axial direction, an urging unit that urges the heat conducting unit toward the heat generating plate, a pressing unit that is disposed in such a manner as to oppose the heat generating plate with the endless belt interposed between the pressing unit and the heat generating plate and that forms a nip between the pressing unit and the endless belt in such a manner as to press the recording medium, which is transported, against the endless belt, and a moving unit that causes the pressing unit to move relative to the endless belt in such a manner as to set a nip width of the nip in a heating mode in which the endless belt is heated to be smaller than the nip width of the nip in a fixing mode in which an image is fixed onto the recording medium. When the heat generating portion that is included in a region of the nip in the transport direction of the recording medium and that generates heat in the heating mode has a length L1, the heat conducting unit that is included in the region of the nip in the transport direction in the heating mode has a length S1, the heat generating portion that is included in the region of the nip in the transport direction and that generates heat in the fixing mode has a length L2, and the heat conducting unit that is included in the region of the nip in the transport direction in the fixing mode has a length S2, the following formula (1) is satisfied.

$$L2-L1<S2-S1 \quad (1)$$

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
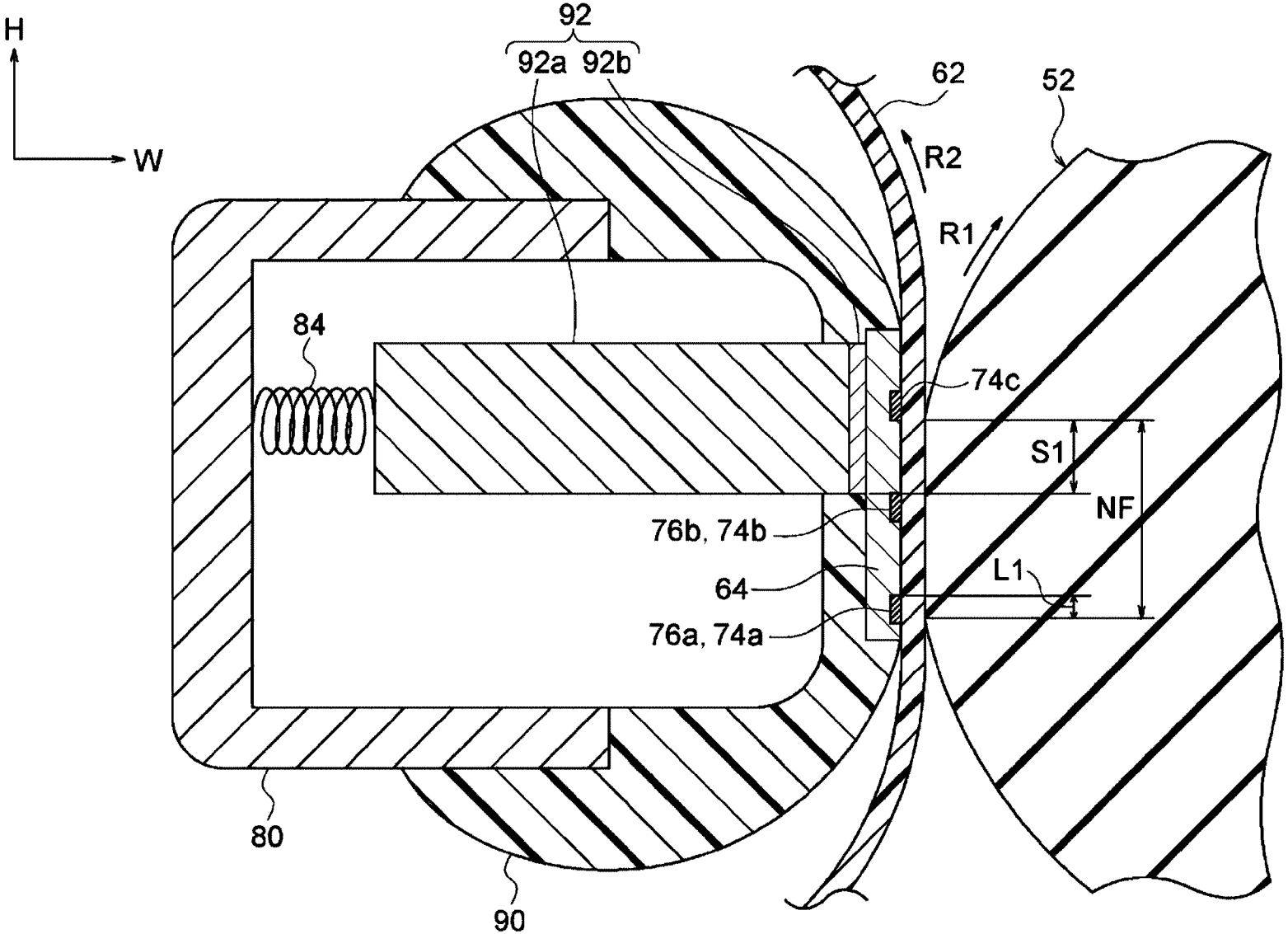
FIG. 1 is an enlarged cross-sectional view illustrating a fixing device according to a first exemplary embodiment of the present disclosure in a heating mode.

An example of a fixing device according to a first exemplary embodiment of the present disclosure and an example of an image forming apparatus according to the first exemplary embodiment will be described with reference to FIG. 1 to FIG. 11. Note that, arrow H, arrow W, and arrow D that are illustrated in the drawings respectively indicate a top-bottom direction of the image forming apparatus (the vertical direction), a width direction of the image forming apparatus (a horizontal direction), and a depth direction of the image forming apparatus (a horizontal direction).

(Overall Configuration)

Figure 10:
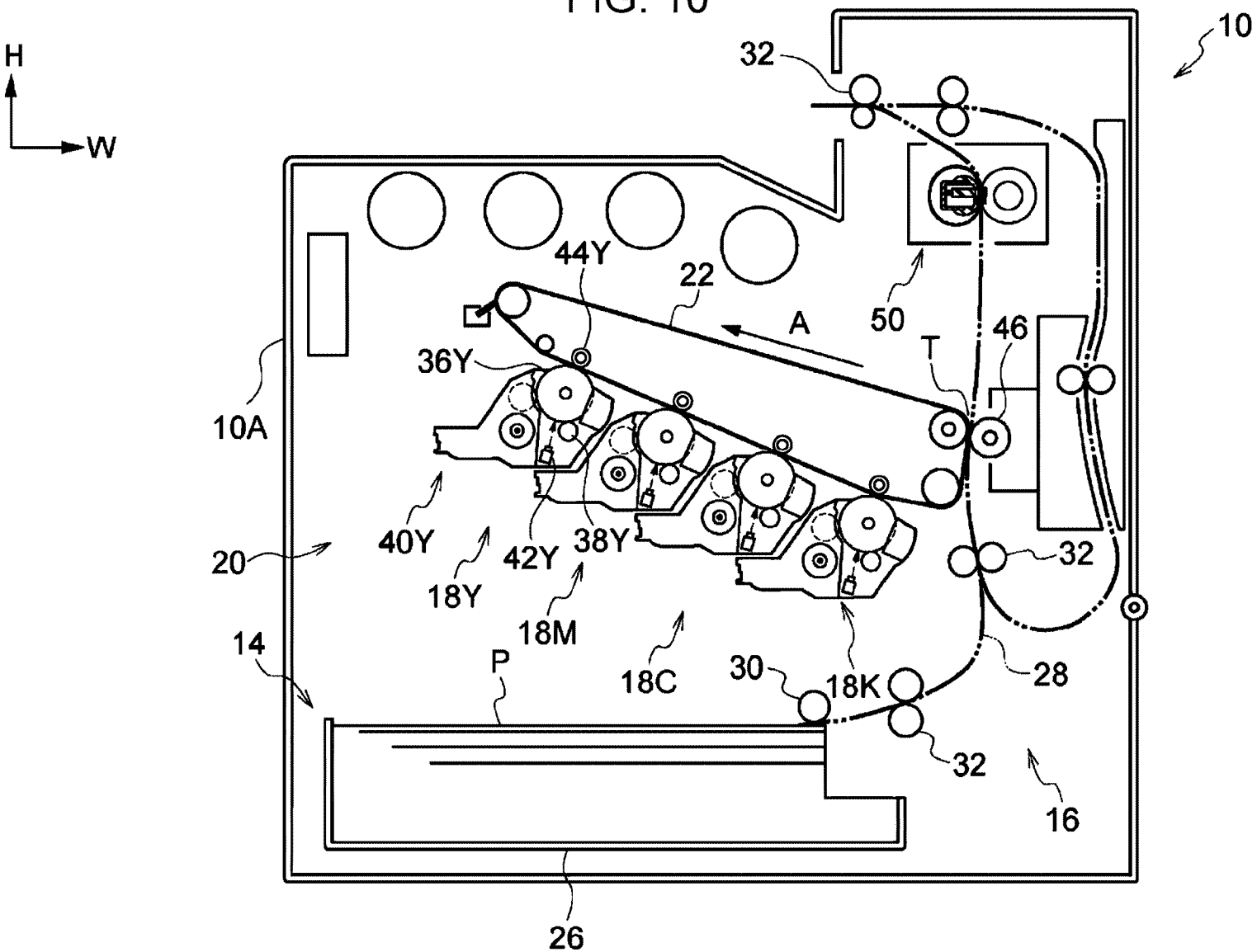
FIG. 10 is a schematic diagram illustrating a configuration of an image forming apparatus according to the first exemplary embodiment of the present disclosure.

As illustrated in FIG. 10, an image forming apparatus 10 according to the first exemplary embodiment includes an accommodating unit 14 in which sheet members P each serving as a recording medium are accommodated, a transport unit 16 that transports the sheet members P accommodated in the accommodating unit 14, and an image forming section 20 that performs an image forming operation on the sheet members P transported from the accommodating unit 14 by the transport unit 16. The accommodating unit 14, the transport unit 16, and the image forming section 20 are arranged in this order starting from the lower side toward the upper side in the top-bottom direction (the direction of arrow H).

[Accommodating Unit 14]

The accommodating unit 14 includes an accommodating member 26 that is capable of being drawn out from an apparatus body 10A of the image forming apparatus 10 toward the near side in the depth direction of the image forming apparatus 10 (hereinafter referred to as "apparatus depth direction"), and the sheet members P are stacked in the accommodating member 26. The accommodating unit 14 further includes a delivery roller 30 that sends out the sheet members P stacked in the accommodating member 26 to a transport path 28 that is included in the transport unit 16.

[Transport Unit 16]

The transport unit 16 includes a plurality of transport rollers 32 that transport the sheet members P along the transport path 28, which is predetermined.

[Image Forming Section 20]

The image forming section 20 includes four image forming units 18Y, 18M, 18C, and 18K respectively corresponding to yellow (Y), magenta (M), cyan (C), and black (K). Note that, in the following description, when it is not necessary to describe the image forming units 18Y, 18M, 18C, and 18K in such a manner as to be distinguished in terms of color, the letters Y, M, C, and K may sometimes be omitted.

The image forming units 18 for the corresponding colors each include an image carrier 36, a charging roller 38 that charges a surface of the image carrier 36, and an exposure device 42 that radiates exposure light onto the charged image carrier 36. In addition, each of the image forming units 18 for the corresponding colors includes a developing device 40 that develops an electrostatic latent image that is formed as a result of the above-mentioned exposure device 42 irradiating the charged image carrier 36 and visualizes the electrostatic latent image as a toner image. Each of the image forming units 18 is an example of a forming unit.

In addition, the image forming section 20 includes an endless transfer belt 22 that moves circularly in the direction of arrow A in FIG. 10 and first transfer rollers 44 that transfer toner images formed by the image forming units 18 for the corresponding colors onto the transfer belt 22. The image forming section 20 further includes a second transfer roller 46 that transfers the toner images, which have been transferred to the transfer belt 22, onto one of the sheet members P and a fixing device 50 that fixes the toner images onto the sheet member P by applying heat and pressure to the sheet member P. Note that details of the fixing device 50 will be described later.

(Operation of Image Forming Apparatus)

In the image forming apparatus 10, an image is formed in the following manner.

First, each of the charging rollers 38, to which a voltage has been applied, comes into contact with a corresponding one of the image carriers 36 for the different colors and uniformly and negatively charges the surface of the image carrier 36 to a predetermined electric potential. Next, each of the exposure devices 42 radiates, on the basis of data input from the outside, the exposure light onto the charged surface of a corresponding one of the image carriers 36 so as to form an electrostatic latent image.

As a result, electrostatic latent images that correspond to the data are formed on the surfaces of the image carriers 36 for the different colors. In addition, the developing devices 40 for the different colors develop the electrostatic latent images and visualize the electrostatic latent images as toner images. The toner images formed on the surfaces of the image carriers 36 for the different colors are transferred onto the transfer belt 22 by the first transfer rollers 44.

One of the sheet members P that is sent out to the transport path 28 from the accommodating member 26 by the delivery roller 30 is sent out to a transfer position T at which the transfer belt 22 and the second transfer roller 46 come into contact with each other. Note that the transfer belt 22 and the second transfer roller 46 may be in contact with each other at all times. At the transfer position T, the toner images on a surface of the transfer belt 22 are transferred onto the sheet member P as a result of the sheet member P being nipped and transported by the transfer belt 22 and the second transfer roller 46.

The toner images that have been transferred to the sheet member P are fixed onto the sheet member P by the fixing device 50. Then, the sheet member P, to which the toner images have been fixed, is ejected out of the housing 10A by the transport rollers 32.

(Configuration of Principal Portion)

The fixing device 50 will now be described.

Figure 5:
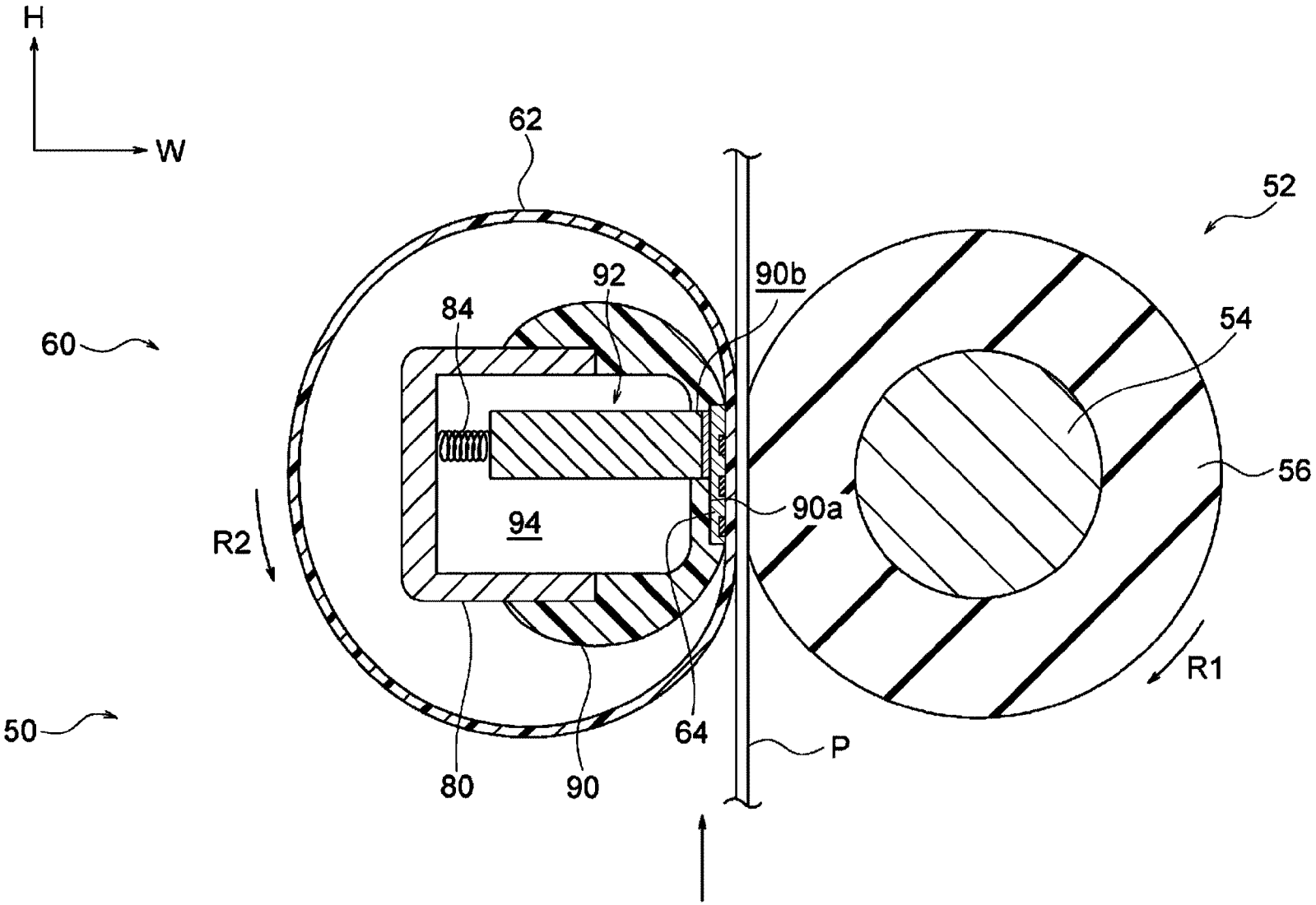
FIG. 5 is a cross-sectional view illustrating the fixing device according to the first exemplary embodiment of the present disclosure in the fixing mode.

The fixing device 50 is attachable and detachable to and from the apparatus body 10A and includes a pressure roller 52 and a heating unit 60 that faces the pressure roller 52 in the width direction of the image forming apparatus 10 (hereinafter referred to as "apparatus width direction") as illustrated in FIG. 5. In addition, the fixing device 50 includes a motor 58 (see FIG. 9) that causes the pressure roller 52 to rotate, moving units 86 (see FIG. 9) that moves the pressure roller 52, and a controller 102 (see FIG. 8) that controls each component.

[Pressure Roller 52]

As illustrated in FIG. 5, the pressure roller 52 includes a metal shaft 54 extending in the apparatus depth direction, a cylindrical elastic layer 56 into which the shaft 54 is inserted, and a release layer (not illustrated) covering the elastic layer 56. The pressure roller 52 is an example of a pressing unit.

The shaft 54 is made of, for example, a metal material, such as iron and steel, a stainless steel, or aluminum. The elastic layer 56 is made of, for example, a rubber material or the like. The release layer is made of, for example, polytetrafluoroethylene perfluoroalkoxyethylene copolymer (PFA) or the like.

In this configuration, the pressure roller 52 is grounded and urged toward the heating unit 60. In addition, a force that causes the pressure roller 52 to rotate is transmitted to the pressure roller 52 from the motor 58 (see FIG. 9), so that the pressure roller 52 rotates in the direction of arrow R1 in FIG. 5. As a result, the pressure roller 52 rotates and presses one of the sheet members P to which toner images have been transferred against the outer peripheral surface of an endless belt 62, which will be described below. Note that, in the first exemplary embodiment, the pressure roller 52 rotates in such a manner that the peripheral velocity of the outer peripheral surface of the elastic layer 56 is set to 230 mm/sec.

[Heating Unit 60]

As illustrated in FIG. 5, the heating unit 60 includes the endless belt 62 that has a cylindrical shape and that extends in the apparatus depth direction, a heat generating plate 64 that generates heat in order to heat the endless belt 62, and a heat conducting member 92 that conducts the heat generated by the heat generating plate 64 in the apparatus depth direction (the axial direction of the endless belt 62). In addition, the heating unit 60 includes a plurality of compression-coil springs 84 (hereinafter referred to as "springs 84") each of which urges the heat conducting member 92 toward the heat generating plate 64, a holding member 90 that holds the heat generating plate 64, and a frame 80 that supports the holding member 90. The heating unit 60 further includes a plurality of sensing members 82 (see FIG. 6) each of which detects the temperature of the heat generating plate 64.

—Endless Belt 62—

As illustrated in FIG. 5, the outer peripheral surface of the endless belt 62 is in contact with the pressure roller 52. As a result of the endless belt 62 and the pressure roller 52 being in contact with each other in this manner, a nip NF (see FIG. 2) is formed, and one of the sheet members P that is transported is to be nipped at the nip NF. For example, the endless belt 62 is made of a polyimide resin, and the outer peripheral surface of the endless belt 62 is coated with fluorine. The thickness of the endless belt 62 is set to 100 μm.

Cylindrical support members (not illustrated) are disposed at the ends of the endless belt 62 in the longitudinal direction of the endless belt 62 so as to support the inner peripheral surface of the endless belt 62. In addition, lubricating oil (which is an example of a liquid and which is, for example, silicone oil) is applied to the inner peripheral surface of the endless belt 62 in order to reduce the frictional resistance that is generated between the endless belt 62 and the heat generating plate 64.

In this configuration, the endless belt 62 is driven by the pressure roller 52, which rotates (moves circularly), and rotates in the direction of arrow R2 in FIG. 5 (the counterclockwise direction) while maintaining a circular shape.

—Holding Member 90—

As illustrated in FIG. 5, the holding member 90 is disposed in a space enclosed by the endless belt 62. The holding member 90 is made of, for example, a resin material such as a liquid crystal polymer (LCP) and extends in the apparatus depth direction. The holding member 90 has a U-shaped cross section in a direction perpendicular to the longitudinal direction of the holding member 90, and a portion of the holding member 90 that is located on the side opposite to the side on which the pressure roller 52 is disposed is open. The thermal conductivity of the holding member 90 is set to 0.56 W/mK.

The holding member 90 includes a to-be-attached portion 90*a* that is formed in a recessed manner so as to face the pressure roller 52, and the heat generating plate 64 is attached to the to-be-attached portion 90*a* with an attachment member (not illustrated) such as an adhesive. In addition, a through hole 90*b* is formed in a portion of the to-be-attached portion 90*a* that is located on a downstream side in a direction in which the sheet members P are transported. The through hole 90*b* extends through the holding member 90 in the apparatus width direction (the direction in which the pressure roller 52 and the heating unit 60 face each other), and a portion of the heat conducting member 92 is disposed in the through hole 90*b*. The to-be-attached portion 90*a* and the through hole 90*b* extend in the apparatus depth direction.

Figure 6:
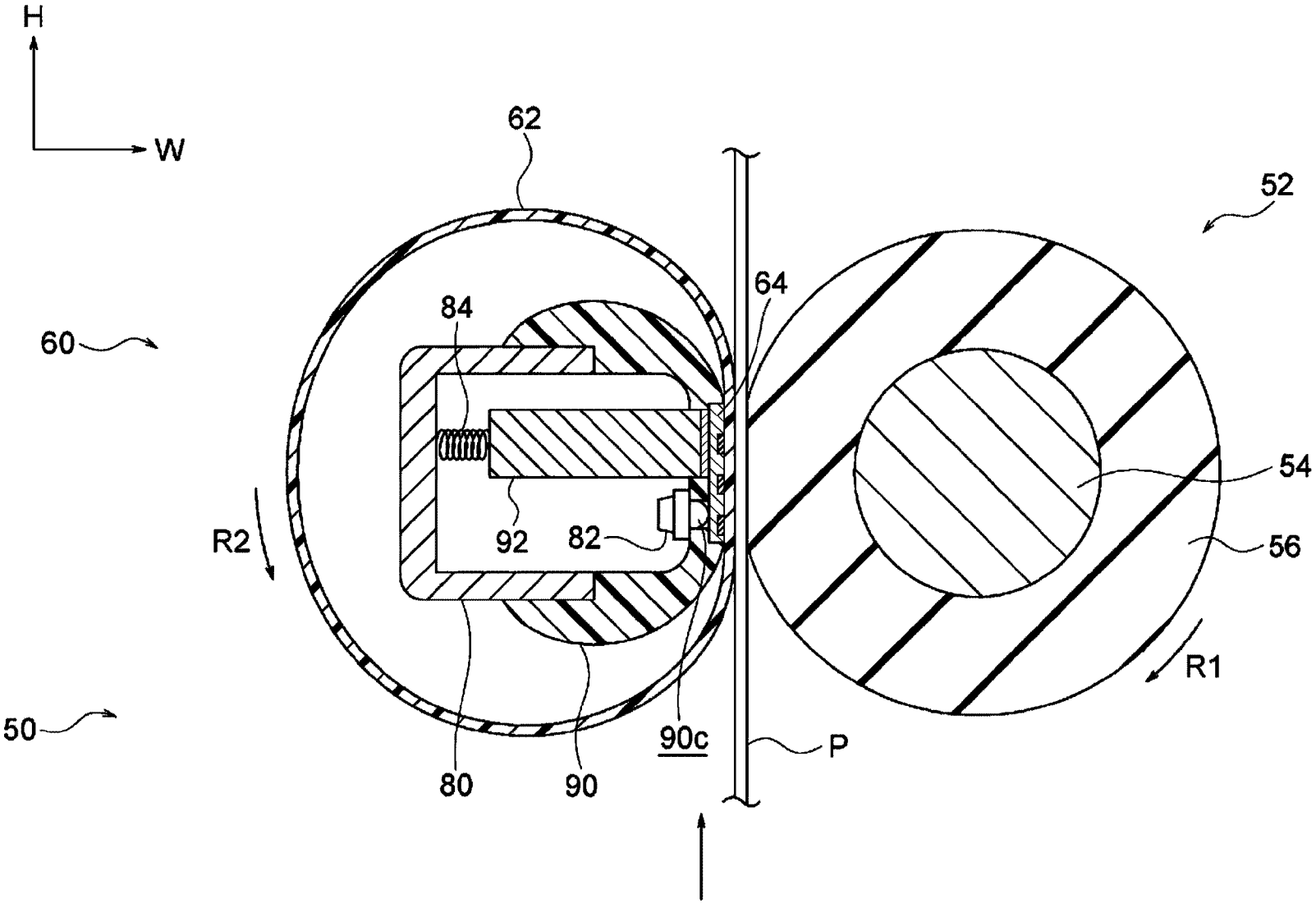
FIG. 6 is a cross-sectional view illustrating the fixing device according to the first exemplary embodiment of the present disclosure in the heating mode.

Furthermore, as illustrated in FIG. 6, a plurality of through holes 90*c* in which the plurality of sensing members 82 are disposed are formed in the holding member 90 in such a manner as to be spaced apart from one another in the apparatus depth direction.

—Frame 80—

As illustrated in FIG. 5, the frame 80 is disposed in the space enclosed by the endless belt 62 so as to oppose the pressure roller 52 with the holding member 90 interposed therebetween. The frame 80 is formed by bending a sheet metal and extends in the apparatus depth direction. The frame 80 has a U-shaped cross section in a direction perpendicular to the longitudinal direction of the frame 80, and a portion of the frame 80 that is located on the side on which the holding member 90 is disposed is open.

End portions of the holding member 90 that correspond to the two end portions of the U-shape of the holding member 90 are attached to end portions of the frame 80 that correspond to the two end portions of the U-shape of the frame 80 with an attachment member (not illustrated) such as an adhesive, so that the frame 80 supports the holding member 90. As a result, a region 94 surrounded by the holding member 90 and the frame 80 is formed in the space enclosed by the endless belt 62. The end portions of the frame 80 in the longitudinal direction of the frame 80 project outward from the endless belt 62, and each of these projecting portions is fixed to a framework member (not illustrated).

—Heat Generating Plate 64—

As illustrated in FIG. 5, the heat generating plate 64 is positioned in such a manner as to oppose the pressure roller 52 with the endless belt 62 interposed therebetween, and a surface of the heat generating plate 64 is in contact with the inner peripheral surface of the endless belt 62. The heat generating plate 64 is a plate-shaped member having a plate surface that is oriented in the apparatus width direction, and the heat generating plate 64 extends from one end to the other end of the endless belt 62 in the apparatus depth direction. As an example, the thickness of the heat generating plate 64 is set to 0.7 mm.

Figure 3:
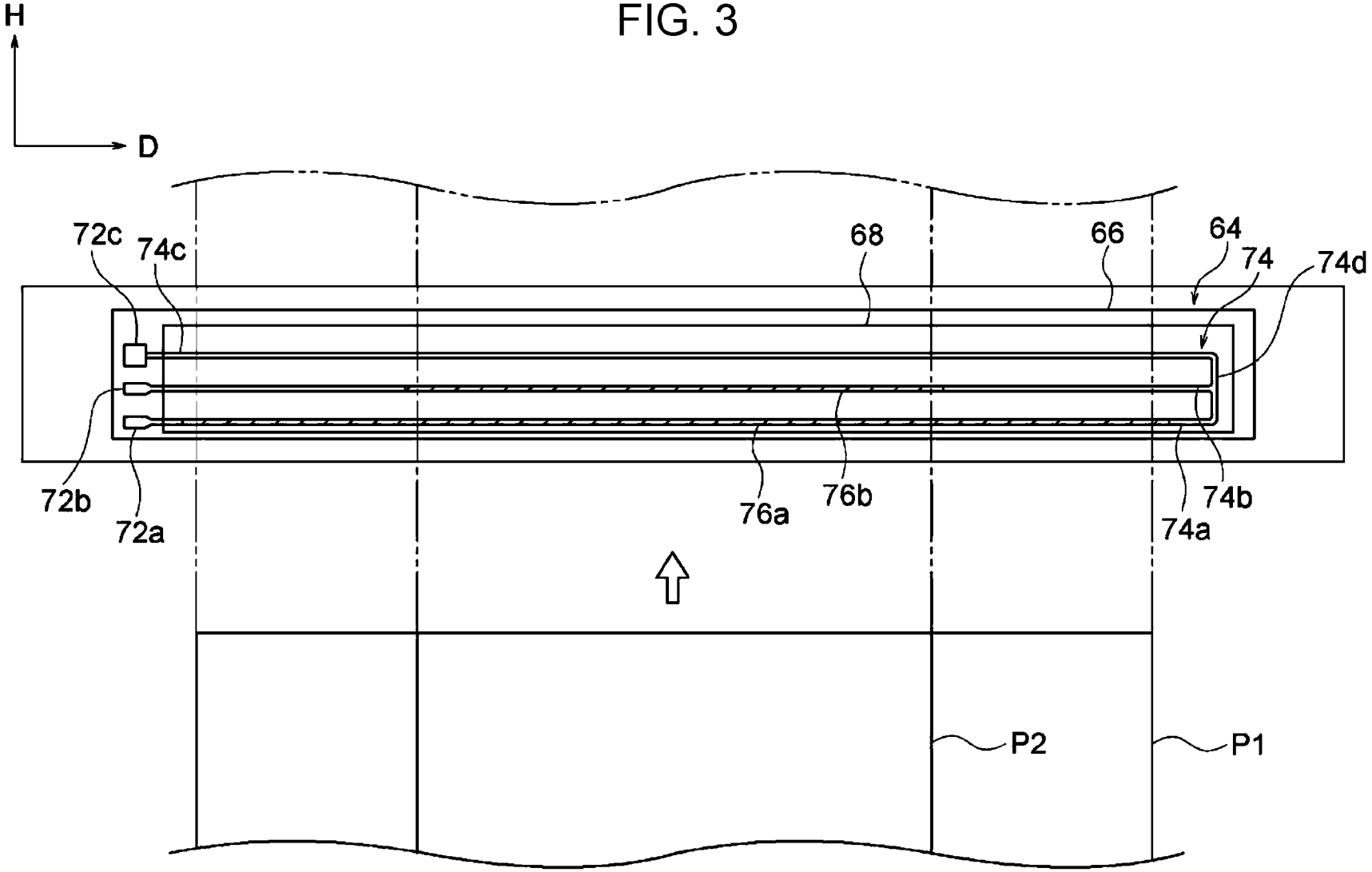
FIG. 3 is a plan view illustrating a heat generating plate of the fixing device according to the first exemplary embodiment of the present disclosure.

As illustrated in FIG. 3, the heat generating plate 64 has a rectangular shape extending in the apparatus depth direction when viewed in a plate-thickness direction thereof. The heat generating plate 64 includes a base member 66 having an electrical insulating property, an insulating film 68 made of a heat-resistant resin material, three electrodes 72*a*, 72*b*, and 72*c* for allowing application of a voltage, and a conducting portion 74 through which a current flows as a result of a voltage being applied to the electrodes 72*a*, 72*b*, and 72*c*. The conducting portion 74 includes resistance heating portions 76*a* and 76*b* (corresponding to shaded portions in FIG. 3) that generate heat as a result of a current flowing therethrough. Here, the wording "having an electrical insulating property" refers to having an electrical conductivity of $1\times10^{-10}$ S/m or less.

The base member 66 is a compact made of alumina, which is a ceramic having an electrical insulating property. The thermal conductivity of the base member 66 is set to 41 W/mK. The electrodes 72*a*, 72*b*, and 72*c* and the conducting portion 74 are formed on a surface (a surface facing the inner peripheral surface of the endless belt 62) of the base member 66. More specifically, the electrodes 72*a*, 72*b*, and 72*c* are formed on a portion of the base member 66 that is located on the near side in the apparatus depth direction and are arranged in this order starting from an upstream side toward a downstream side in the direction in which the sheet members P are transported (hereinafter referred to as "sheet transport direction"), which is the top-bottom direction in FIG. 3.

The conducting portion 74 is coated with the insulating film 68 and includes a first conducting portion 74*a* extending from the electrode 72*a* toward the far side in the apparatus depth direction, a second conducting portion 74*b* extending from the electrode 72*b* toward the far side in the apparatus depth direction, and a third conducting portion 74*c* extending from the electrode 72*c* toward the far side in the apparatus depth direction. In addition, the conducting portion 74 includes a connecting portion 74*d* that extends in the sheet transport direction in such a manner as to connect a terminal portion of the first conducting portion 74*a*, a terminal portion of the second conducting portion 74*b*, and a terminal portion of the third conducting portion 74*c* to one another.

The first conducting portion 74*a* includes the resistance heating portion 76*a*, and the resistance heating portion 76*a* is formed to have a length in the apparatus depth direction (a width direction of a sheet member P1 that is transported and that is illustrated in FIG. 3) that is equal to or larger than the size of a region through which the sheet member P1, which is one of the sheet members P and which has the largest size, passes. The second conducting portion 74*b* includes the resistance heating portion 76*b*, and the resistance heating portion 76*b* is formed to have a length in the apparatus depth direction that is equal to or larger than the size of a region through which a sheet member P2 (illustrated in FIG. 3) that is transported and that is one of the sheet members P having the smallest size passes. The resistance heating portion 76*a* is longer than the resistance heating portion 76*b*. In addition, the width of the resistance heating portion 76*a* (the length of the resistance heating portion 76*a* in the sheet transport direction) and the width of the resistance heating portion 76*b* (the length of the resistance heating portion 76*b* in the sheet transport direction) are similar to each other. Each of the resistance heating portions 76*a* and 76*b* is an example of a heat generating portion.

Note that the image forming apparatus 10 employs a center registration system in which the side edges of each of the sheet members P in the width direction of the sheet member P are supported so as to align the positions of the sheet members P while the center of each of the sheet members P in the width direction functions as a reference.

In this configuration, in order to fix toner images onto one of the sheet members P, in a heating mode (a start-up mode) in which the endless belt 62 is heated, the controller 102 (see FIG. 8) switches on a power switch (not illustrated) and causes a voltage to be applied to the electrode 72*a* and the electrode 72*c* regardless of the size of the sheet member P. As a result, in the heating mode, heat is generated in the resistance heating portion 76*a*, which is included in the first conducting portion 74*a*, and heat is not generated in the resistance heating portion 76*b*, which is included in the second conducting portion 74*b*. In other words, in the heating mode, heat is generated in the resistance heating portion 76*a* that is farthest from the heat conducting member 92 in the sheet transport direction, and heat is not generated in the resistance heating portion 76*b* that is closest to the heat conducting member 92 in the sheet transport direction.

—Heat Conducting Member 92—

As illustrated in FIG. 5, the heat conducting member 92 is disposed in the region 94, which is surrounded by the holding member 90 and the frame 80, and has a rectangular shape extending in the apparatus width direction when viewed in the apparatus depth direction. In addition, a portion of the heat conducting member 92 that faces the heat generating plate 64 is inserted in the through holes 90*c* of the holding member 90. The heat conducting member 92 is an example of a heat conducting unit.

Figure 2:
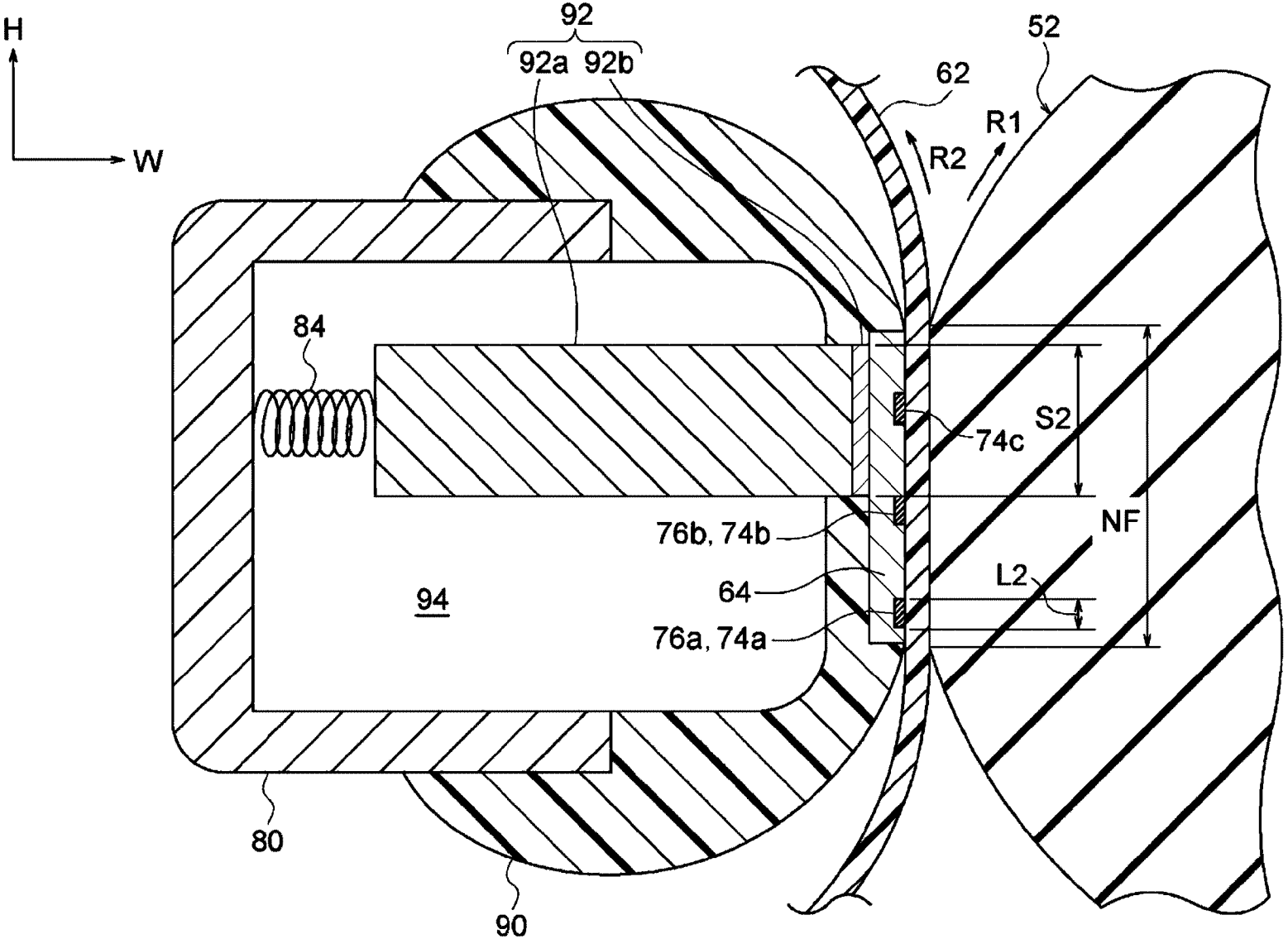
FIG. 2 is an enlarged cross-sectional view illustrating the fixing device according to the first exemplary embodiment of the present disclosure in a fixing mode.

In addition, an end surface of the heat conducting member 92 that faces the heat generating plate 64 is in contact with a portion of the rear surface of the heat generating plate 64, the portion being located on the downstream side in the sheet transport direction (the top-bottom direction in FIG. 5). More specifically, as illustrated in FIG. 2, the end surface of the heat conducting member 92 is in contact with the rear surface of a portion of the heat generating plate 64, the portion being different from a portion of the heat generating plate 64 on which the resistance heating portion 76*a* and the resistance heating portion 76*b* are formed in the sheet transport direction. In other words, the end surface of the heat conducting member 92 is in contact with the rear surface of a portion of the heat generating plate 64, the portion being different from a portion of the heat generating plate 64 where heat is generated in the sheet transport direction.

The heat conducting member 92 includes a body 92*a* that has a rectangular parallelepiped shape and a sheet-shaped member 92*b* that is made of silicone and that is placed on an end surface of the body 92*a*, the end surface facing the heat generating plate 64. The body 92*a* is made of copper, and the thermal conductivity of the body 92*a* is set to 403 W/mK. In this manner, the thermal conductivity of the body 92*a* is set to higher than the thermal conductivity of the base member 66 of the heat generating plate 64.

Here, as described above, the heat conducting member 92 and the resistance heating portions 76*a* and 76*b* are disposed at different positions in the sheet transport direction. As a result, heat generated in the resistance heating portions 76*a* and 76*b* is conducted through the base member 66 toward the downstream side in the sheet transport direction and then is transferred to the heat conducting member 92. Subsequently, the heat conducting member 92 conducts the heat in the apparatus depth direction. As mentioned above, heat that has been conducted through the base member 66 toward the downstream side in the sheet transport direction is transferred to the heat conducting member 92.

—Sensing Members 82—

The plurality of sensing members 82 are arranged in such a manner as to be spaced apart from one another in the apparatus depth direction, and as illustrated in FIG. 6, a portion of each of the sensing members 82 is disposed in a corresponding one of the through holes 90*c* formed in the holding member 90. Each of the sensing members 82 is in contact with a portion of the rear surface of the heat generating plate 64, the portion being located on the upstream side in the sheet transport direction (the top-bottom direction in FIG. 6). More specifically, the sensing members 82 is in contact with the rear surface of the portion of the heat generating plate 64 in which the resistance heating portions 76*a* and 76*b* (see FIG. 3) are formed in the sheet transport direction.

In this configuration, the sensing members 82 detect the temperature of the heat generating plate 64. The controller 102 (see FIG. 8) starts or stops application of a voltage to each of the electrodes 72*a*, 72*b*, and 72*c* (see FIG. 3) by controlling switching of the power switch (not illustrated) on and off in such a manner that the temperature of the heat generating plate 64 detected by each of the sensing members 82 is within a predetermined range.

—Springs 84—

Figure 7:
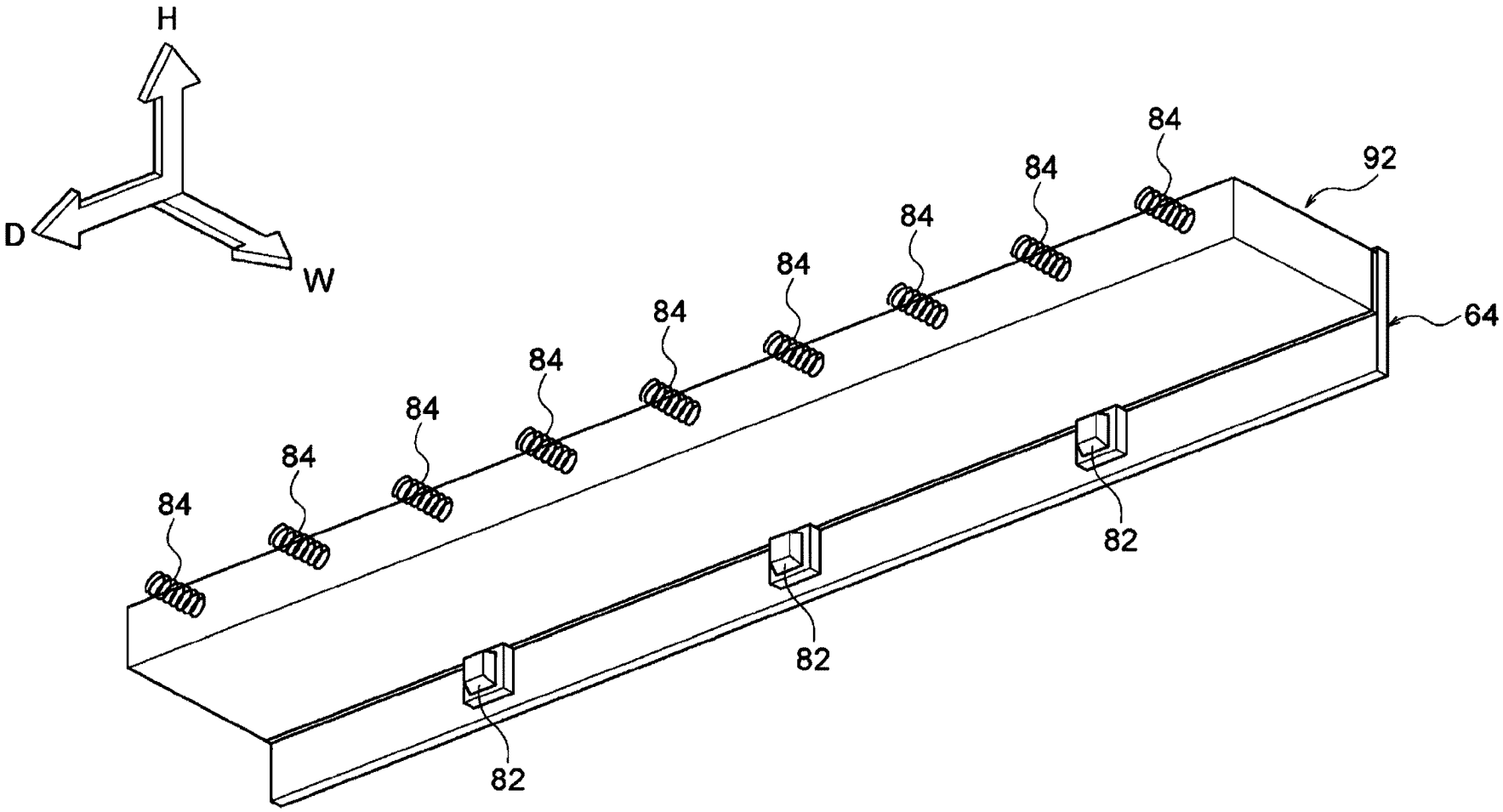
FIG. 7 is a perspective view illustrating a heat conducting member and springs of the fixing device according to the first exemplary embodiment of the present disclosure.

As illustrated in FIG. 5, each of the springs 84 is disposed at a position located on the side opposite to the side on which the heat generating plate 64 is disposed with the heat conducting member 92 interposed therebetween and extends in the apparatus width direction. In addition, the springs 84 are arranged in such a manner as to be sandwiched between the frame 80 and the heat conducting member 92. Furthermore, as illustrated in FIG. 7, the plurality of springs 84 are arranged in such a manner as to be spaced apart from one another in the apparatus depth direction.

In this configuration, the plurality of springs 84 urge the heat conducting member 92 toward the heat generating plate 64. Each of the springs 84 is an example of an urging unit.

[Moving Units 86]

Figure 9:
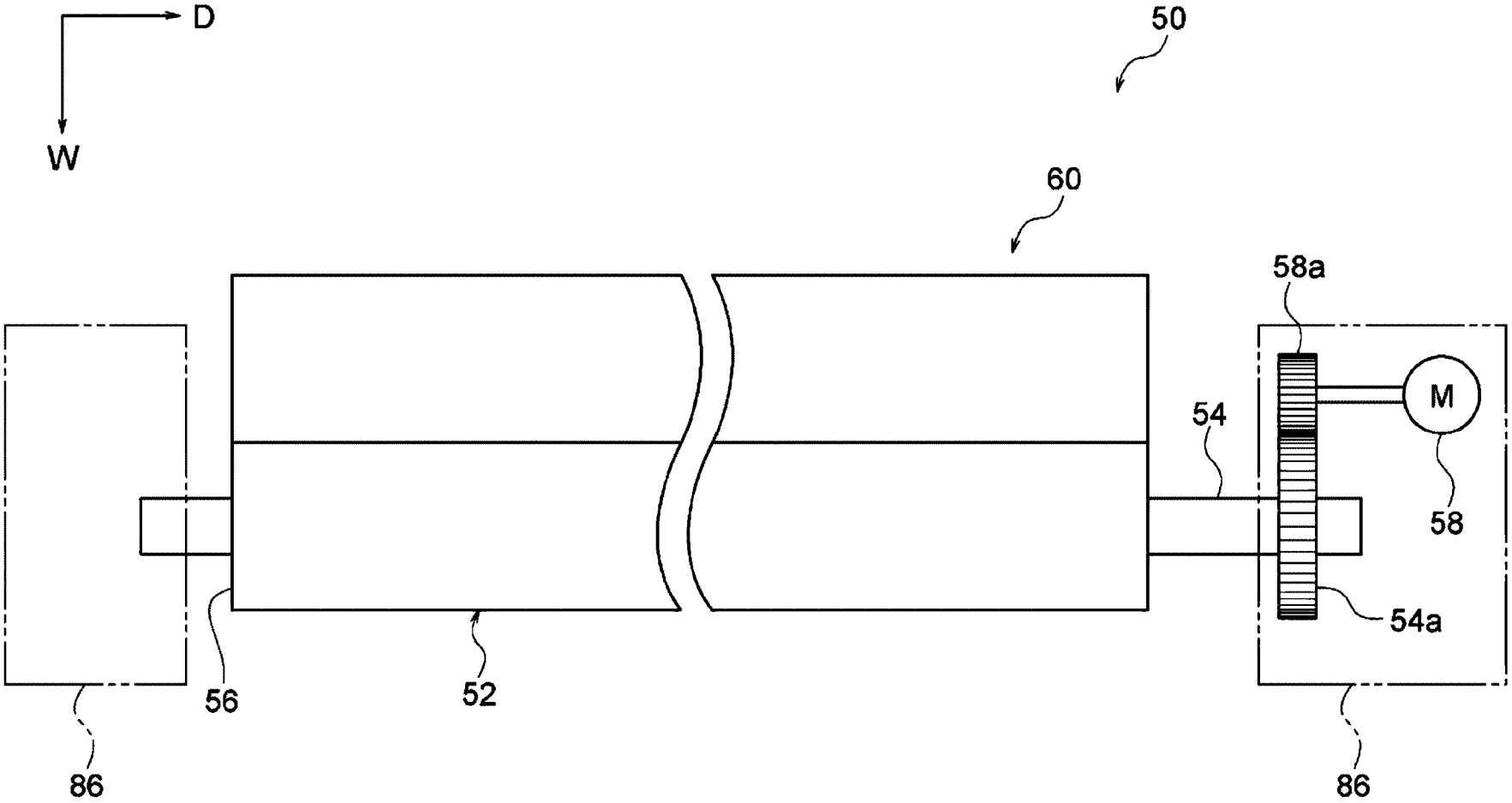
FIG. 9 is a front view illustrating the fixing device according to the first exemplary embodiment of the present disclosure.

As illustrated in FIG. 9, the moving units 86 are arranged on the sides of the pressure roller 52 in the apparatus depth direction and are each formed by combining known machine elements.

The moving units 86 are configured to move the pressure roller 52 in the apparatus width direction and in the top-bottom direction of the image forming apparatus 10 so as to change a nip width of the nip NF (see FIG. 1 and FIG. 2). More specifically, the moving units 86 move the pressure roller 52 to a first position (see FIG. 2) or a second position (see FIG. 1). When the pressure roller 52 is at the first position, the nip width is set such that one of the sheet members P is nipped between the pressure roller 52 and the endless belt 62 and such that toner images are fixed onto the sheet member P. When the pressure roller 52 is at the second position, the nip width is smaller than the nip width when the pressure roller 52 is at the first position. In this manner, each of the moving units 86 functions as a nip-width changing unit that changes the nip width of the nip NF.

More specifically, in order to fix toner images onto one of the sheet members P, in the heating mode (start-up mode) in which the endless belt 62 is heated, the controller 102 controls the moving units 86 so as to cause the pressure roller 52 to move to the second position. On the other hand, in a fixing mode in which toner images that have been formed on one of the sheet members P are fixed onto the sheet member P by applying heat and pressure to the sheet member P, the controller 102 controls the moving units 86 so as to cause the pressure roller 52 to move to the first position.

As illustrated in FIG. 1, in a state where the pressure roller 52 is located at the second position in the heating mode, the resistance heating portion 76*a* that is included in the region of the nip NF in the sheet transport direction has a length L1. Note that, as mentioned above, heat is generated in the resistance heating portion 76*a* of the first conducting portion 74*a* in the heating mode. In this state, the heat conducting member 92 that is included in the region of the nip NF in the sheet transport direction has a length S1. More specifically, in a state where the pressure roller 52 is located at the second position in the heating mode, the resistance heating portion 76*a* and the heat conducting member 92 are partially included in the region of the nip NF in the sheet transport direction. Regarding the region of the nip NF, when a sheet-shaped member in or on which elements that are capable of detecting pressure are arranged in a matrix is nipped in the nip NF, it is determined that a region of the sheet-shaped member where a voltage equal to or greater than a threshold is generated corresponds to the region of the nip NF.

As illustrated in FIG. 2, in a state where the pressure roller 52 is located at the first position in the fixing mode, the resistance heating portion 76*a* that is included in the region of the nip NF in the sheet transport direction has a length L2. Note that, it is assumed that heat is generated in the resistance heating portion 76*a* of the first conducting portion 74*a* in the fixing mode. In this state, the heat conducting member 92 that is included in the region of the nip NF in the sheet transport direction has a length S2. More specifically, in a state where the pressure roller 52 is located at the first position in the fixing mode, the entire resistance heating portion 76*a* and the entire heat conducting member 92 are included in the region of the nip NF in the sheet transport direction. In this case, the second position of the pressure roller 52 and the first position of the pressure roller 52 are set in such a manner that the following formula (1) is satisfied.

$$L2-L1<S2-S1 \quad (1)$$

It is understood from the formula (1) that the length of the heat conducting member 92 that is included in the region of the nip NF in the sheet transport direction changes. In other words, each of the moving units 86 functions as an in-nip heat-conducting length changing unit that changes the length of the heat conducting member 92 that is included in the region of the nip NF.

More specifically, the length S1 (see FIG. 1) of the heat conducting member 92 that is included in the region of the nip NF in the sheet transport direction in the heating mode is smaller than the length S2 (see FIG. 2) of the heat conducting member 92 that is included in the region of the nip NF in the sheet transport direction in the fixing mode.

Thus, a press-contact force of the heat generating plate 64 and the heat conducting member 92 in the heating mode is smaller than a press-contact force of the heat generating plate 64 and the heat conducting member 92 in the fixing mode. In other words, each of the moving units 86 functions as a press-contact force changing unit that changes the press-contact force of the heat conducting member 92 and the heat generating plate 64.

In this case where the press-contact force of the heat generating plate 64 and the heat conducting member 92 in the heating mode is smaller than the press-contact force of the heat generating plate 64 and the heat conducting member 92 in the fixing mode, the heat-transfer coefficient between the heat generating plate 64 and the heat conducting member 92 in the heating mode is lower than the heat-transfer coefficient between the heat generating plate 64 and the heat conducting member 92 in the fixing mode. In other words, the heat-transfer coefficient between the heat generating plate 64 and the heat conducting member 92 in the fixing mode is higher than the heat-transfer coefficient between the heat generating plate 64 and the heat conducting member 92 in the heating mode. That is to say, each of the moving units 86 functions as a transfer-coefficient changing unit that changes the heat-transfer coefficient between the heat conducting member 92 and the heat generating plate 64.

It is understood from the formula (1) that the length of the resistance heating portion 76*a* that is included in the region of the nip NF in the sheet transport direction changes. In other words, each of the moving units 86 functions as an in-nip heating-portion length changing unit that changes the length of the resistance heating portion 76*a* that is included in the region of the nip NF.

[Controller 102]

Figure 8:
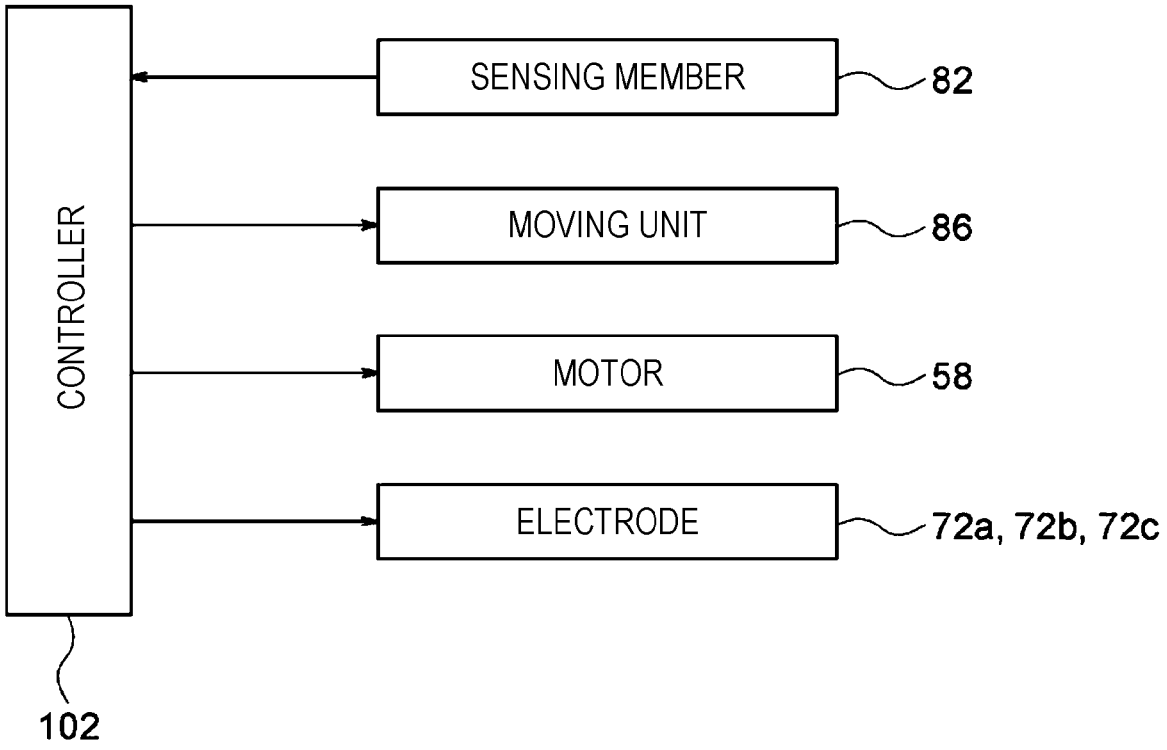
FIG. 8 is a block diagram illustrating a control system of a controller of the fixing device according to the first exemplary embodiment of the present disclosure.

As illustrated in FIG. 8, the controller 102 controls application of the voltage to each of the electrodes 72*a*, 72*b*, and 72*c* by controlling switching of the power switch (not illustrated) on and off on the basis of detection results obtained by the sensing members 82. Note that control of each unit performed by the controller 102 will be described below together with operation of the fixing device 50.

(Operation)

Operation of the fixing device 50 will now be described in comparison to a fixing device 550 according to a comparative example. First, a difference between the configuration of the fixing device 550 according to the comparative example and the configuration of the fixing device 50 will now be described. In addition, differences between the operation of the fixing device 550 and the operation of the fixing device 50 will be described. Note that the operations of the fixing devices 50 and 550 in the case where toner images are fixed onto the sheet member P1, which has the largest size, will be described.

—Configuration of Fixing Device 550—

Unlike the configuration of the fixing device 50, the fixing device 550 does not include a movable unit. The fixing device 550 is configured in a manner similar to the fixing device 50 except that the fixing device 550 does not include a movable unit.

Figure 11:
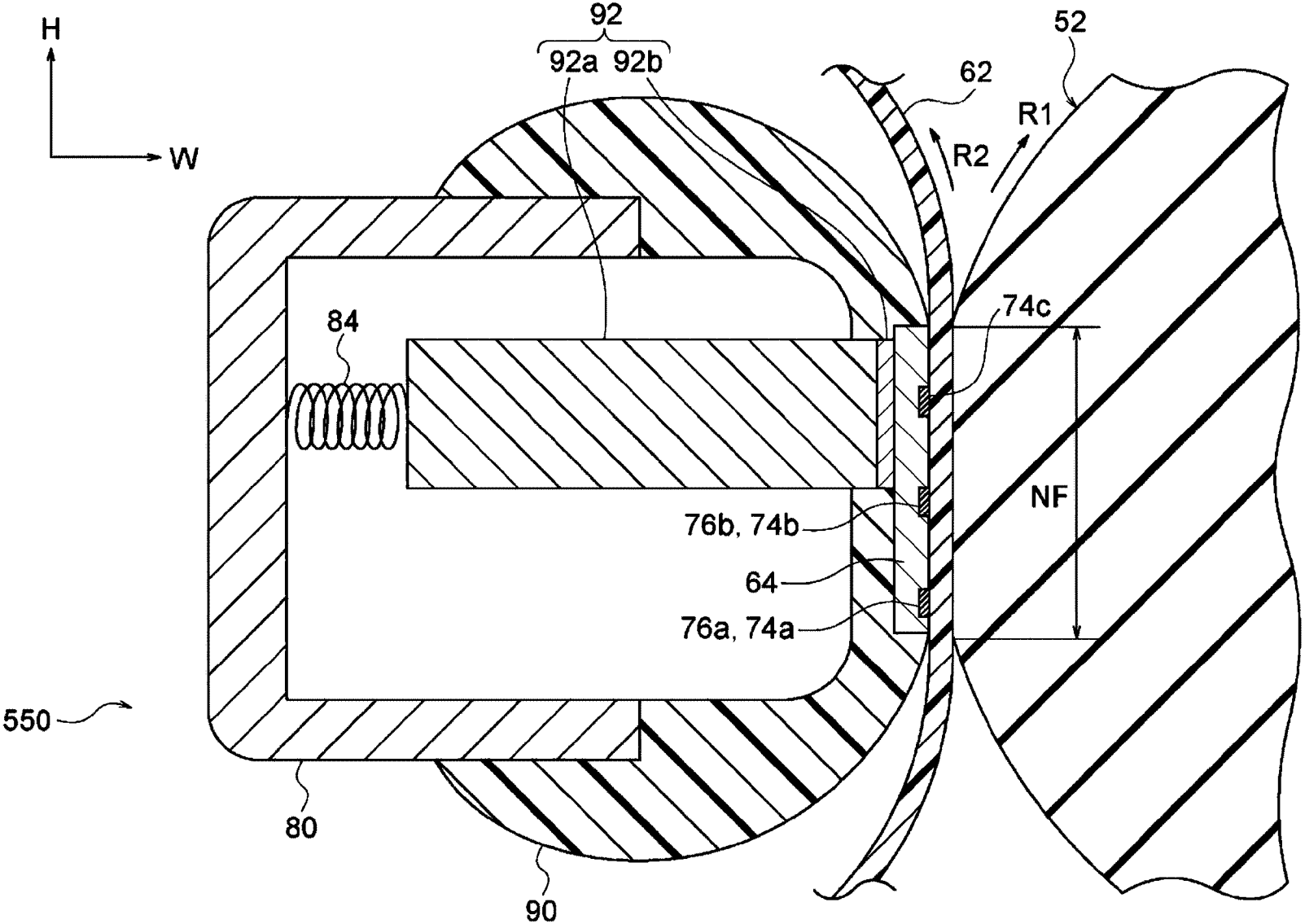
FIG. 11 is an enlarged cross-sectional view illustrating a fixing device according to a comparative example for the first exemplary embodiment of the present disclosure, the fixing device being in the heating mode.

As illustrated in FIG. 11, in the fixing device 550, the nip width of the nip NF does not change between the heating mode and the fixing mode. More specifically, in the fixing device 550, the pressure roller 52 is continuously located at the first position. In other words, the entire resistance heating portion 76*a* and the entire heat conducting member 92 are included in the region of the nip NF in the sheet transport direction.

In other words, in the fixing device 550, the value obtained by subtracting the length of the heat conducting member 92 that is included in the region of the nip NF in the sheet transport direction in the fixing mode from the length of the heat conducting member 92 that is included in the region of the nip NF in the sheet transport direction in the heating mode is zero. That is to say, the length of the heat conducting member 92 that is included in the region of the nip NF in the heating mode and the length of the heat conducting member 92 that is included in the region of the nip NF in the fixing mode are equal to each other.

—Operations of Fixing Devices 50 and 550—

Figure 4:
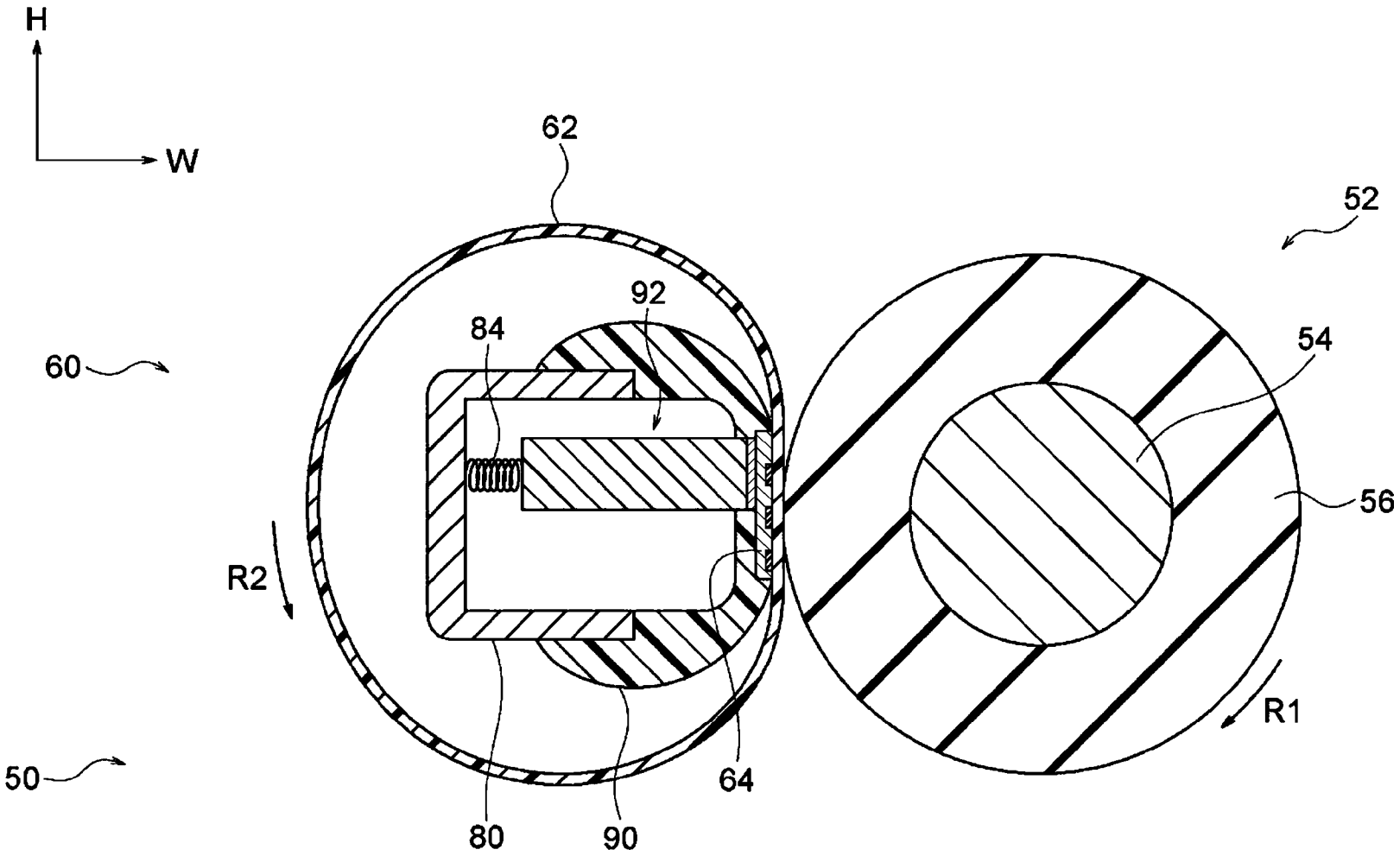
FIG. 4 is a cross-sectional view illustrating the fixing device according to the first exemplary embodiment of the present disclosure in the heating mode.

In a state where the fixing device 50 illustrated in FIG. 4 has not yet started operating, application of the voltage to each of the electrodes 72*a*, 72*b*, and 72*c* (see FIG. 3) is stopped, and the pressure roller 52 is located at the second position and is not rotating.

In contrast, in a state where the fixing device 550 illustrated in FIG. 11 has not yet started operating, application of the voltage to each of the electrodes 72*a*, 72*b*, and 72*c* (see FIG. 3) is stopped, and the pressure roller 52 is located at the first position and is not rotating.

In the case where toner images that have been transferred to one of the sheet members P are fixed onto the sheet member P, the fixing devices 50 and 550 are caused to transition to the heating mode by their controllers 102 (see FIG. 8). More specifically, each of the controllers 102 controls the corresponding motor 58 so as to transmit a rotational force to the corresponding pressure roller 52. Then the pressure rollers 52 illustrated in FIG. 4 and FIG. 11 rotate in the direction of arrow R1 in FIG. 4 and FIG. 11. As a result, the endless belts 62 that are in contact with the corresponding pressure rollers 52 are driven by the pressure rollers 52, which rotate, and rotate in the direction of arrow R2 in FIG. 4 and FIG. 11.

When the endless belts 62 rotate, the corresponding controllers 102 switch on the corresponding power switches (not illustrated) so as to start application of the voltage to each of the corresponding electrodes 72*a* and 72*c* (see FIG. 3). As a result, heat is generated in the corresponding resistance heating portions 76*a*, and the corresponding heat generating plates 64 generate heat. Then the heat generating plates 64 heat the corresponding endless belts 62, which are rotating, from the spaces enclosed by the inner peripheral surfaces of the endless belts 62.

Here, in the fixing device 550 illustrated in FIG. 11, the pressure roller 52 is continuously located at the first position.

Thus, the nip width in the fixing device 550 in the heating mode is wider than the nip width in the fixing device 50 in the heating mode.

Since the nip width in the fixing device 550 in the heating mode is wide, the amount of heat that is transferred to the pressure roller 52 from the heat generating plate 64 via the endless belt 62 is large. Therefore, in the fixing device 550, it takes a longer time for the heat generating plate 64 to reach a specified temperature compared with the case of using the fixing device 50.

In addition, in the fixing device 550, in the heating mode, the entire heat conducting member 92 is included in the region of the nip NF in the sheet transport direction. Thus, in the fixing device 550, the heat-transfer coefficient between the heat generating plate 64 and the heat conducting member 92 in the heating mode is higher than the heat-transfer coefficient between the heat generating plate 64 and the heat conducting member 92 of the fixing device 50 in the heating mode.

Furthermore, in the fixing device 550, since the heat-transfer coefficient between the heat generating plate 64 and the heat conducting member 92 in the heating mode is high, the amount of heat that is transferred to the heat conducting member 92 from the heat generating plate 64 in the heating mode is larger than that in the case of using the fixing device 50. In other words, in the fixing device 50, the amount of heat that is transferred to the heat conducting member 92 from the heat generating plate 64 in the heating mode is smaller than that in the case of using the fixing device 550.

In contrast, in the fixing device 50, the above-mentioned formula (1) is satisfied. In other words, when the value obtained by subtracting the length S1 of the heat conducting member 92 that is included in the region of the nip NF in the heating mode from the length S2 of the heat conducting member 92 that is included in the region of the nip NF in the fixing mode is a value S2−S1, and the value obtained by subtracting the length L1 of the resistance heating portion 76*a* that is included in the region of the nip NF in the heating mode from the length L2 of the resistance heating portion 76*a* that is included in the region of the nip NF in the fixing mode is a value L2−L1, the value S2−S1 is larger than the value L2−L1.

In other words, a decrease in the length of the heat conducting member 92 that is included in the region of the nip NF has greater influence than a decrease in the length of the resistance heating portion 76*a* that is included in the region of the nip NF.

In the manner described above, in the fixing device 50, the time taken for the heat generating plate 64 to reach the specified temperature in the heating mode is shorter than that in the case of using the fixing device 550.

When the temperature detected by each of the sensing members 82 (see FIG. 6) reaches 200° C. (an example of the specified temperature), the heating mode (start-up mode) in which the endless belt 62 is heated is shifted to the fixing mode in which toner images are fixed onto one of the sheet members P.

More specifically, in the fixing device 50, the controller 102 controls the moving units 86 so as to move the pressure roller 52 to the first position. In addition, after the heating mode has been shifted to the fixing mode, the controller 102 continues application of the voltage to each of the electrodes 72*a* and 72*c* in order to toner images are fixed onto the sheet member P1, which has the largest size.

Then, the heating unit 60 and the pressure roller 52 nip and transport the sheet member P to which the toner images have been transferred, so that the toner images are fixed onto the sheet member P. In addition, as a result of the sheet member P to which the toner images have been transferred being nipped and transported by the heating unit 60 and the pressure roller 52, the heat of a portion of the heat generating plate 64 over which the sheet member P passes is absorbed by the sheet member P. Consequently, the temperature of the heat generating plate 64 decreases. Accordingly, as an example, the controller 102 controls switching of the power switch (not illustrated) on and off in such a manner that the temperature of the heat generating plate 64 is within a range of 190° C. to 230° C., inclusive.

When each of the fixing devices 50 and 550 stops its operation after a series of operations for forming the toner images onto the sheet member P, each of the controllers 102 switches off the corresponding power switch (not illustrated) so as to stop application of the voltage to each of the corresponding electrodes 72*a* and 72*c* (see FIG. 3). In addition, each of the controllers 102 controls the corresponding motor 58 so as to cause the corresponding pressure roller 52 to stop rotating. In the fixing device 50, the controller 102 controls the moving units 86 so as to move the pressure roller 52 to the second position.

Note that, in the case where toner images are fixed onto the sheet member P2, which has the smallest size, after the heating mode has been shifted to the fixing mode, the controller 102 controls switching of the power switch (not illustrated) on and off so as to stop application of the voltage to the electrodes 72*a* and 72*c* and so as to start application of the voltage to the electrodes 72*b* and 72*c*. As a result, heat is generated in the resistance heating portion 76*b*.

In the case where one of the sheet members P that has a size larger than the smallest size of the sheet member P2 is used, after the heating mode has been shifted to the fixing mode, the controller 102 continues application of the voltage to the electrodes 72*a* and 72*c*.

SUMMARY

As described above, since the above formula (1) is satisfied in the fixing device 50, the time taken for the heat generating plate 64 to reach the specified temperature in the heating mode is shorter than that in the case of using the fixing device 550.

In the fixing device 50, in the heating mode, at least a portion of the resistance heating portion 76*a* having the largest length is included in the region of the nip NF in the sheet transport direction. In addition, in the heating mode, heat is generated in the resistance heating portion 76*a*. Thus, the time taken for the heat generating plate 64 to reach the specified temperature in the heating mode is shorter than that in the case where a resistance heating portion that generates heat is shorter than another resistance heating portion in the heat mode.

In the fixing device 50, in the heating mode, heat is generated in the resistance heating portion 76*a* that is different from the resistance heating portion 76*b*, which is closest to the heat conducting member 92 in the sheet transport direction. In other words, only the resistance heating portion 76*b*, which is closest to the heat conducting member 92 in the sheet transport direction, generates no heat. Thus, the amount of heat that is transferred to the heat conducting member 92 from the resistance heating portion 76*a* in the heating mode is smaller than the amount of heat that is transferred to the heat conducting member 92 from the resistance heating portion 76*b* in the heating mode in the case where heat is generated only in the resistance heating portion 76*b*, which is closest to the heat conducting member 92 in the sheet transport direction, and thus, the time taken for the heat generating plate 64 to reach the specified temperature is reduced.

In the fixing device 50, in the heating mode, heat is generated in the resistance heating portion 76*a* that is farthest from the heat conducting member 92 in the sheet transport direction. Thus, the amount of heat that is transferred to the heat conducting member 92 from the resistance heating portion 76*a* in the heating mode is smaller than the amount of heat that is transferred to the heat conducting member 92 from the resistance heating portion 76*b* in the heating mode in the case where heat is generated only in the resistance heating portion 76*b*, which is different from the resistance heating portion 76*a* that is farthest from the heat conducting member 92, and thus, the time taken for the heat generating plate 64 to reach the specified temperature is reduced.

In the image forming apparatus 10, the time taken to output the first sheet member P after the image forming apparatus 10 has been started up is shorter than that in the case where the image forming apparatus 10 includes the fixing device 550 instead of the fixing device 50.

Second Exemplary Embodiment

An example of a fixing device according to a second exemplary embodiment of the present disclosure and an example of an image forming apparatus according to the second exemplary embodiment will now be described with reference to FIG. 12. Note that a difference between the second exemplary embodiment and the first exemplary embodiment will be described. In a fixing device 150 according to the second exemplary embodiment, the state in which the pressure roller 52 is located at the second position is the only difference from the fixing device 50 according to the first exemplary embodiment.

Figure 12:
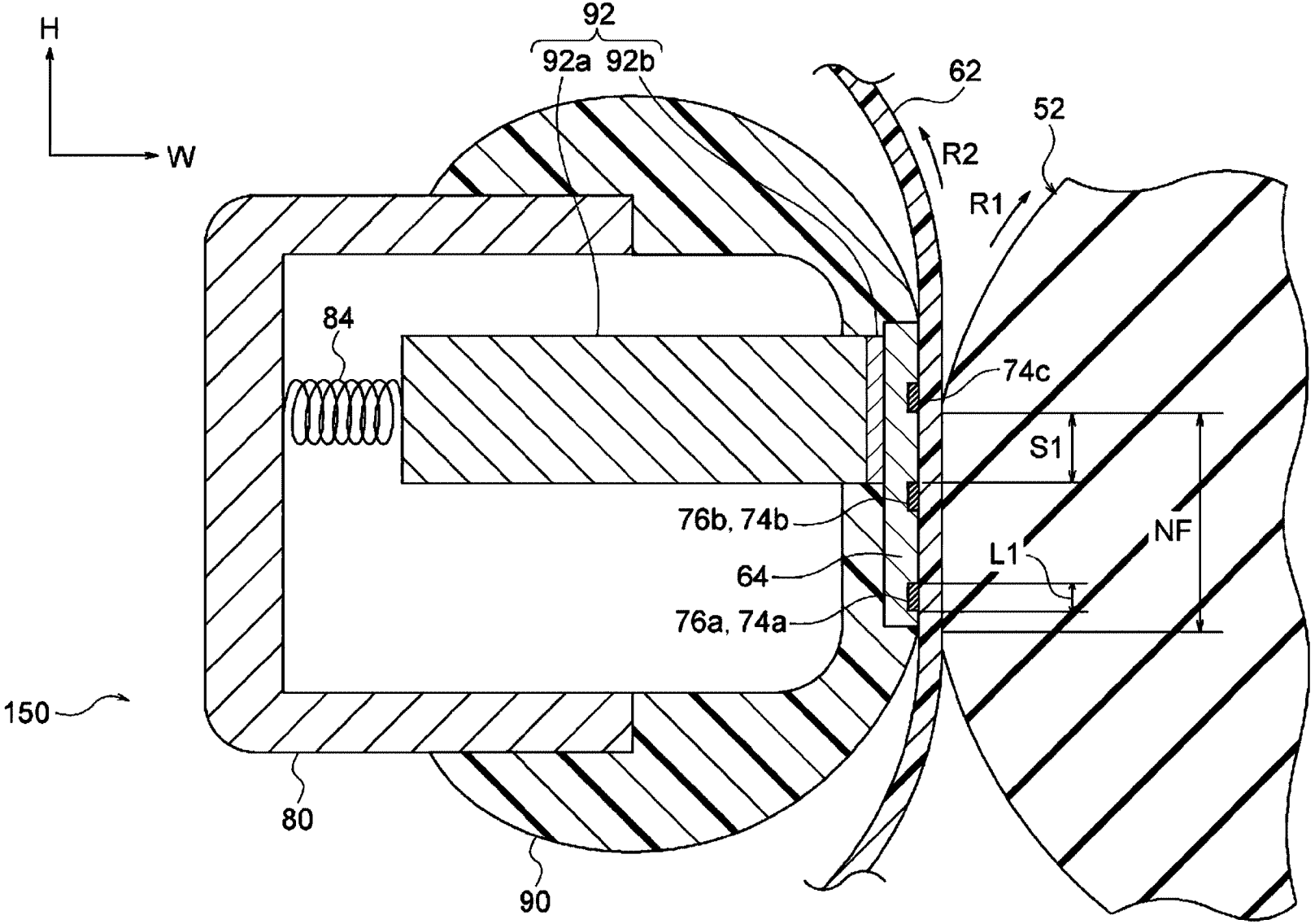
FIG. 12 is an enlarged cross-sectional view illustrating a fixing device according to a second exemplary embodiment of the present disclosure in the heating mode.

More specifically, as illustrated in FIG. 12, in the state where the pressure roller 52 is located at the second position, the entire resistance heating portion 76*a* is included in the region of the nip NF in the sheet transport direction. In other words, the length L1 of the resistance heating portion 76*a* that is included in the region of the nip NF in the sheet transport direction in the heating mode and the length L2 of the resistance heating portion 76*a* that is included in the region of the nip NF in the sheet transport direction in the fixing mode have similar values. Note that the phrase "have similar values" refers to the case where one of the values is 90% or higher and 110% or lower of the other value by taking into consideration assembly tolerances, movement tolerances, and the like.

As a result, in the fixing device 150, the time taken for the heat generating plate 64 to reach the specified temperature in the heating mode is shorter than that in the case where the length L2 of the resistance heating portion 76*a* is shorter than the length L1 of the resistance heating portion 76*a*.

Third Exemplary Embodiment

An example of a fixing device according to a third exemplary embodiment of the present disclosure and an example of an image forming apparatus according to the third exemplary embodiment will now be described with reference to FIG. 13 to FIG. 15. Note that a difference between the third exemplary embodiment and the first exemplary embodiment will be described.

Figure 13:
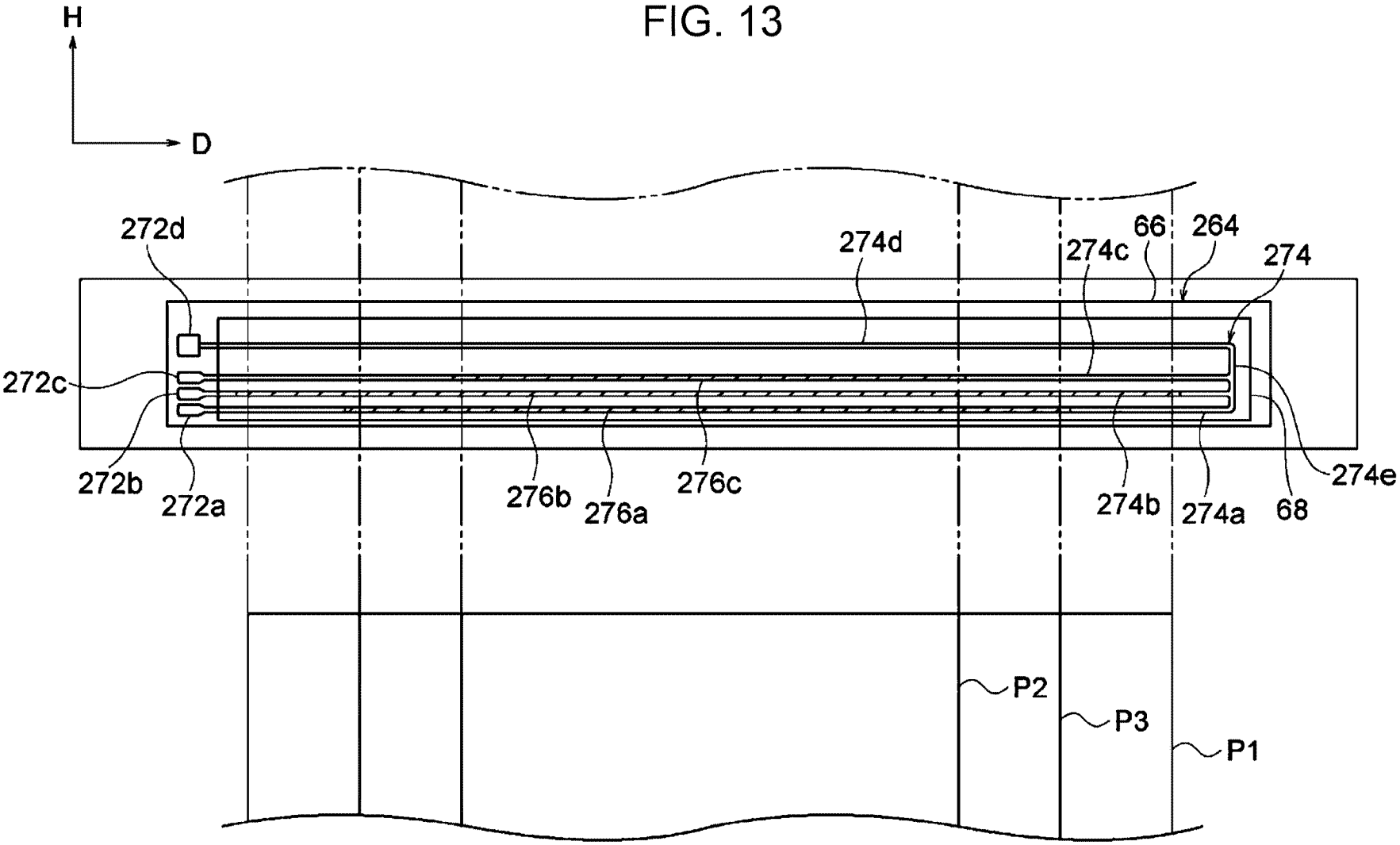
FIG. 13 is a plan view illustrating a heat generating plate of a fixing device according to a third exemplary embodiment of the present disclosure.

A heat generating plate 264 that is included in a fixing device 250 according to the third exemplary embodiment has a rectangular shape extending in the apparatus depth direction as illustrated in FIG. 13. The heat generating plate 264 includes the base member 66 having an electrical insulating property, the insulating film 68 made of a heat-resistant resin material, four electrodes 272*a*, 272*b*, 272*c*, and 272*d* for allowing application of a voltage, and a conducting portion 274 through which a current flows as a result of a voltage being applied to the electrodes 272*a*, 272*b*, 272*c*, and 272*d*. The conducting portion 274 includes resistance heating portions 276*a*, 276*b*, and 276*c* (corresponding to shaded portions in FIG. 13) that generate heat as a result of the current flowing therethrough.

The electrodes 272*a*, 272*b*, 272*c*, and 272*d* are arranged in this order starting from the upstream side toward the downstream side in the sheet transport direction.

The conducting portion 274 is coated with the insulating film 68 and includes a first conducting portion 274*a* extending from the electrode 272*a* toward the far side in the apparatus depth direction, a second conducting portion 274*b* extending from the electrode 272*b* toward the far side in the apparatus depth direction, and a third conducting portion 274*c* extending from the electrode 272*c* toward the far side in the apparatus depth direction. In addition, the conducting portion 274 includes a fourth conducting portion 274*d* extending from the electrode 272*d* toward the far side in the apparatus depth direction and a connecting portion 274*e* that extends in the sheet transport direction in such a manner as to connect a terminal portion of the first conducting portion 274*a*, a terminal portion of the second conducting portion 274*b*, a terminal portion of the third conducting portion 274*c*, and a terminal portion of the fourth conducting portion 274*d* to connect with one another.

The first conducting portion 274*a* includes the resistance heating portion 276*a*, and the resistance heating portion 276*a* is formed to have a length in the apparatus depth direction (a width direction of a sheet member P3 illustrated in FIG. 13) that is equal to or larger than the size of a region through which the sheet member P3, which is one of the sheet members P and which has a size that is most commonly used in the image forming apparatus 10, passes. The second conducting portion 274*b* includes the resistance heating portion 276*b*, and the resistance heating portion 276*b* is formed to have a length in the apparatus depth direction that is equal to or larger than the size of a region through which the sheet member P1, which has the largest size, passes. The third conducting portion 274*c* includes the resistance heating portion 276*c*, and the resistance heating portion 276*c* is formed to have a length that is equal to or larger than the size of a region through which the sheet member P2, which has the smallest size, passes.

In other words, the length of the resistance heating portion 276*b* is the largest, followed by the length of the resistance heating portion 276*a* and the length of the resistance heating portion 276*c* in descending order. In addition, the width (the length in the sheet transport direction) of the resistance heating portion 276*a*, the width (the length in the sheet transport direction) of the resistance heating portion 276*b*, the width (the length in the sheet transport direction) of the resistance heating portion 276*c* are similar to one another. Each of the resistance heating portions 276*a*, 276*b*, and 276*c* is an example of a heat generating portion.

Figure 15:
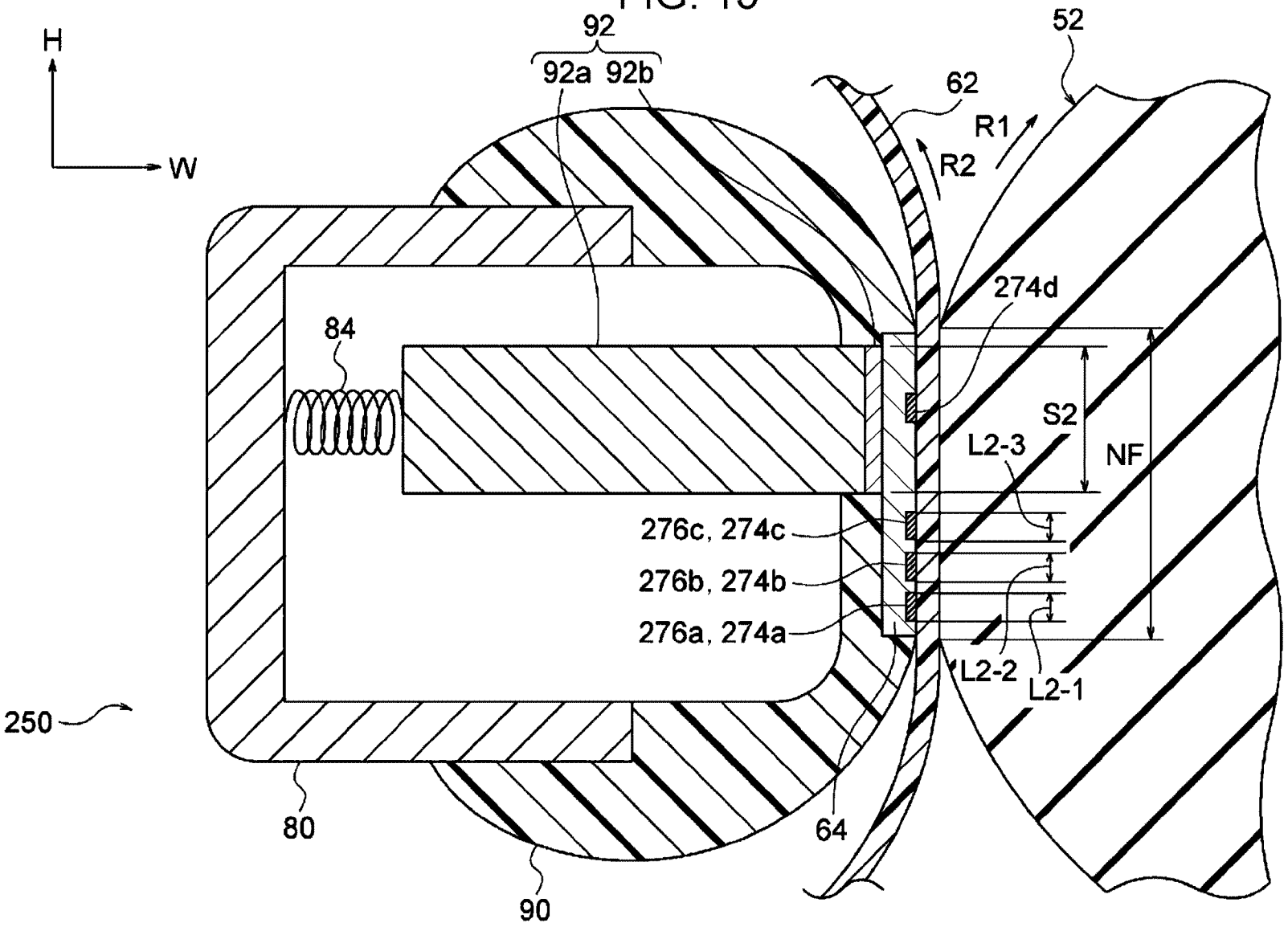
FIG. 15 is an enlarged cross-sectional view illustrating the fixing device according to the third exemplary embodiment of the present disclosure in the fixing mode.

As illustrated in FIG. 15, the resistance heating portions 276*a*, 276*b*, and 276*c* are positioned further upstream than the heat conducting member 92 in the sheet transport direction.

In this configuration, in a state where the pressure roller 52 is located at the first position in the fixing mode, as illustrated in FIG. 15, the entire resistance heating portions 276*a*, 276*b*, and 276*c* are included in the region of the nip NF in the sheet transport direction. In addition, the entire heat conducting member 92 is included in the region of the nip NF in the sheet transport direction.

In the case where an image is fixed onto the sheet member P1 having the largest size, in the fixing mode, a voltage is applied to the electrode 272*b* and the electrode 272*d*, and heat is generated in the resistance heating portion 276*b*. In the case where an image is fixed onto the sheet member P2 having the smallest size, in the fixing mode, a voltage is applied to the electrode 272*c* and the electrode 272*d*, and heat is generated in the resistance heating portion 276*c*. In the case where an image is fixed onto the sheet member P3 having the most commonly used size, in the fixing mode, a voltage is applied to the electrode 272*a* and the electrode 272*d*, and heat is generated in the resistance heating portion 276*a*. In the case where an image is fixed onto one of the sheet members P that has a size other than the above-mentioned sizes, heat is generated in one of the resistance heating portions 276*a*, 276*b*, and 276*c* that has a length in the apparatus depth direction (the width direction of the sheet member P) equal to or larger than the size of the sheet member P and that is the shortest.

Figure 14:
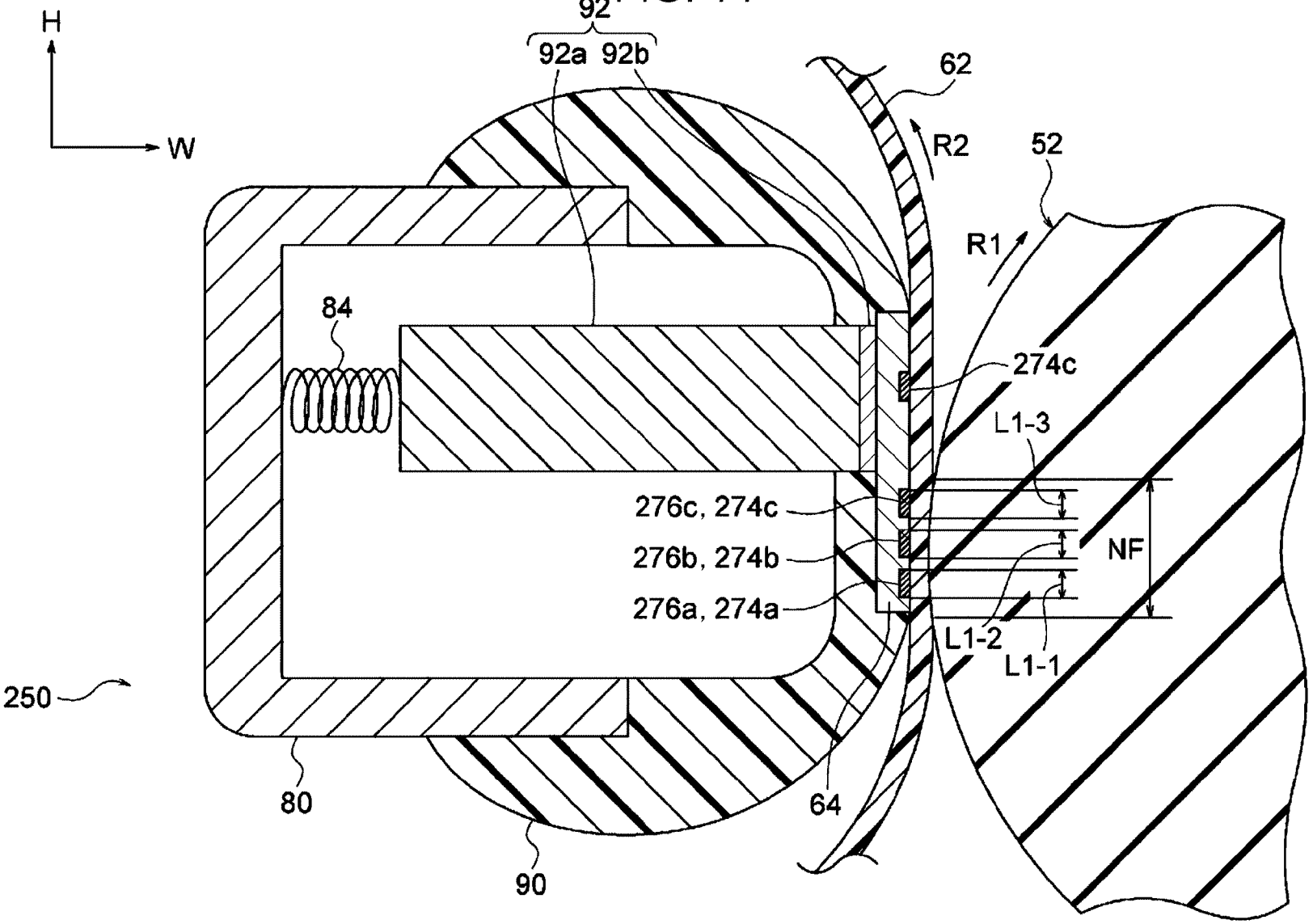
FIG. 14 is an enlarged cross-sectional view illustrating the fixing device according to the third exemplary embodiment of the present disclosure in the heating mode.

In a state where the pressure roller 52 is located at the second position in the heating mode, as illustrated in FIG. 14, the entire resistance heating portions 276*a*, 276*b*, and 276*c* are included in the region of the nip NF in the sheet transport direction. The resistance heating portion 276*b* that has the largest length in the apparatus depth direction is located in a center portion of the nip NF in the sheet transport direction. Here, the center portion of the nip NF in the sheet transport direction is a center portion of the nip NF when the nip NF is divided into three equal portions in the sheet transport direction.

In addition, the entire heat conducting member 92 is not included in the region of the nip NF in the sheet transport direction. In other words, the length S1 of the heat conducting member 92 included in the region of the nip NF in the sheet transport direction in the heating mode is zero. That is to say, there is no length S1 of the heat conducting member 92 that is included in the region of the nip NF in the sheet transport direction.

In the heating mode, the voltage is applied to all the electrodes 272*a*, 272*b*, 272*c*, and 272*d*, and heat is generated in all the resistance heating portions 276*a*, 276*b*, and 276*c*. In other words, the length L1 of the resistance heating portions that are included in the region of the nip NF in the sheet transport direction and that generate heat in the heating mode is the sum of a length L1-1 of the resistance heating portion 276*a*, a length L1-2 of the resistance heating portion 276*b*, and a length L1-3 of the resistance heating portion 276*c* that are illustrated in FIG. 14. Similarly, in the fixing mode, the length L2 of the resistance heating portion that is included in the region of the nip NF in the sheet transport direction and that generates heat in the heating mode is a length L2-1 illustrated in FIG. 15 when heat is generated in the resistance heating portion 276*a* or a length L2-2 illustrated in FIG. 15 when heat is generated in the resistance heating portion 276*b*. In addition, when heat is generated in the resistance heating portion 276*c*, the length L2 of the resistance heating portion is a length L2-3 illustrated in FIG. 15.

As described above, in the fixing device 250, the entire resistance heating portions 276*a*, 276*b*, and 276*c* are included in the region of the nip NF in the sheet transport direction in the heating mode. In addition, in the heating mode, heat is generated in all the resistance heating portions 276*a*, 276*b*, and 276*c*. Thus, the time taken for the heat generating plate 64 to reach the specified temperature in the heating mode is shorter than that in the case where there is a resistance heating portion that does not generate heat in the heating mode.

In the fixing device 250, in the heating mode, the resistance heating portion 276*b* having the largest length is located in the center portion of the nip NF in the sheet transport direction. Thus, in the heating mode, even if there are variations in the relative positions of the pressure roller 52 and the endless belt 62, the probability that the resistance heating portion 276*b* having the largest length will be outside of the region of the nip NF is lower than that in the case where the resistance heating portion 276*b* is located in an end portion of the nip NF. As a result, the time taken for the heat generating plate 64 to reach the specified temperature in the heating mode is shorter than that in the case where the resistance heating portion 276*b* is located in an end portion of the nip NF.

In addition, in the fixing device 250, there is no length S1 of the heat conducting member 92 that is included in the region of the nip NF in the sheet transport direction in the heating mode (the length S1 is zero). Thus, the amount of heat that is transferred to the heat conducting member 92 from the heat generating plate 64 is smaller than that in the case where there is the length S1 of the heat conducting member 92 that is included in the region of the nip NF in the sheet transport direction in the heating mode (the length S1 is greater than zero). As a result, the time taken for the heat generating plate 64 to reach the specified temperature in the heating mode is shorter than that in the case where there is the length S1 of the heat conducting member 92 that is included in the region of the nip NF in the sheet transport direction in the heating mode (the length S1 is greater than zero).

Note that although specific exemplary embodiments of the present disclosure have been described in detail, the present disclosure is not limited to the exemplary embodiments, and it is obvious to those skilled in the art that the present disclosure may employ other various exemplary embodiments within the scope of the present disclosure. For example, in the above-described exemplary embodiments, although the heat conducting member 92 includes the sheet-shaped member 92*b*, which is made of silicone and which is placed on the end surface thereof that faces the heat generating plate 64, it is not particularly necessary for the heat conducting member 92 to include the sheet-shaped member 92*b*.

In the first and second exemplary embodiments, the resistance heating portions 76*a* and 76*b* and the heat conducting member 92 are arranged in this order starting from the upstream side in the sheet transport direction, and in the third exemplary embodiment, the resistance heating portions 276*a*, 276*b*, and 276*c* and the heat conducting member 92 are arranged in this order starting from the upstream side in the sheet transport direction. However, the heat conducting member 92 and the resistance heating portions 76*a* and 76*b* may be arranged in this order starting from the upstream side in the sheet transport direction, and the heat conducting member 92 and the resistance heating portions 276*a*, 276*b*, and 276*c* may be arranged in this order starting from the upstream side in the sheet transport direction. In the above-described exemplary embodiments, the nip width is changed as a result of movement of the pressure roller 52, the nip width may be changed as a result of movement of at least one of the heating unit 60 and the pressure roller 52.

In the above-described exemplary embodiments, although the springs 84 are each used as an urging unit, a different elastic member such as an elastic pad may be used as long as the elastic member urges the heat conducting member 92 toward the heat generating plate 64.

In the above-described exemplary embodiments, although the center registration system has been described as an example, a side registration system in which an end of each of the sheet members P in the width direction of the sheet member P functions as a reference may be employed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

an endless belt that rotates in a circumferential direction and that comes into contact with a recording medium, which is transported, at an outer peripheral surface of the endless belt;

a heat generating plate that includes at least one heat generating portion and extends in an axial direction of the endless belt in such a manner that a surface of the heat generating plate is in contact with an inner peripheral surface of the endless belt, the heat generating portion being formed in such a manner as to extend in the axial direction and in such a manner as to generate heat;

a heat conducting unit that is in contact with a rear surface of a portion of the heat generating plate, the portion being different from a portion of the heat generating plate on which the heat generating portion is formed in a transport direction of the recording medium, and that conducts heat generated by the heat generating portion in the axial direction;

an urging unit that urges the heat conducting unit toward the heat generating plate;

a pressing unit that is disposed in such a manner as to oppose the heat generating plate with the endless belt interposed between the pressing unit and the heat generating plate and that forms a nip between the pressing unit and the endless belt in such a manner as to press the recording medium, which is transported, against the endless belt; and a moving unit that causes the pressing unit to move relative to the endless belt in such a manner as to set a nip width of the nip in a heating mode in which the endless belt is heated to be smaller than the nip width of the nip in a fixing mode in which an image is fixed onto the recording medium, wherein, when the heat generating portion that is included in a region of the nip in the transport direction of the recording medium and that generates heat in the heating mode has a length L1, the heat conducting unit that is included in the region of the nip in the transport direction in the heating mode has a length S1, the heat generating portion that is included in the region of the nip in the transport direction and that generates heat in the fixing mode has a length L2, and the heat conducting unit that is included in the region of the nip in the transport direction in the fixing mode has a length S2, the following formula (1) is satisfied:

$$L2-L1<S2-S1 \quad (1).$$

2. The fixing device according to claim 1, wherein the length L1 and the length L2 have similar values.

3. The fixing device according to claim 2, wherein the at least one heat generating portion includes a plurality of heat generating portions, and the plurality of heat generating portions that have different lengths in the axial direction are arranged in the transport direction, and wherein, in the heating mode, one of the heat generating portions that has the largest length in the axial direction is included in the region of the nip in the transport direction, and heat is generated in the heat generating portion having the largest length in the heating mode.

4. The fixing device according to claim 3, wherein all the heat generating portions are included in the region of the nip in the transport direction in the heating mode, and heat is generated in all the heat generating portions in the heating mode.

5. The fixing device according to claim 4, wherein, in the heating mode, the heat generating portion having the largest length in the axial direction is located in a center portion of the nip in the transport direction.

6. The fixing device according to claim 2, wherein the at least one heat generating portion includes a plurality of heat generating portions, and the plurality of heat generating portions having different lengths in the axial direction are arranged in the transport direction, and wherein, in the heating mode, heat is not generated in one of the heat generating portions that is closest to the heat conducting unit in the transport direction, and heat is generated in another one of the heat generating portions that is different from the heat generating portion closest to the heat conducting unit.

7. The fixing device according to claim 6, wherein, in the heating mode, heat is generated in one of the heat generating portions that is farthest from the heat conducting unit in the transport direction.

8. The fixing device according to claim 1, wherein the at least one heat generating portion includes a plurality of heat generating portions, and the plurality of heat generating portions that have different lengths in the axial direction are arranged in the transport direction, and wherein, in the heating mode, one of the heat generating portions that has the largest length in the axial direction is included in the region of the nip in the transport direction, and heat is generated in the heat generating portion having the largest length in the heating mode.

9. The fixing device according to claim 8, wherein all the heat generating portions are included in the region of the nip in the transport direction in the heating mode, and heat is generated in all the heat generating portions in the heating mode.

10. The fixing device according to claim 9, wherein, in the heating mode, the heat generating portion having the largest length in the axial direction is located in a center portion of the nip in the transport direction.

11. The fixing device according to claim 1, wherein the at least one heat generating portion includes a plurality of heat generating portions, and the plurality of heat generating portions having different lengths in the axial direction are arranged in the transport direction, and wherein, in the heating mode, heat is not generated in one of the heat generating portions that is closest to the heat conducting unit in the transport direction, and heat is generated in another one of the heat generating portions that is different from the heat generating portion closest to the heat conducting unit.

12. The fixing device according to claim 11, wherein, in the heating mode, heat is generated in one of the heat generating portions that is farthest from the heat conducting unit in the transport direction.

13. The fixing device according to claim 1, wherein there is no length S1.

14. An image forming apparatus comprising:

a forming unit that forms an image onto a recording medium; and the fixing device according to claim 1 that fixes an image that has been formed on the recording medium onto the recording medium.

* * * * *